US007729634B2

(12) United States Patent
Nakamori et al.

(10) Patent No.: US 7,729,634 B2
(45) Date of Patent: Jun. 1, 2010

(54) IMAGE FORMING APPARATUS, IMAGE FORMING METHOD, AND PROCESS CARTRIDGE

(75) Inventors: Hideo Nakamori, Numazu (JP); Masanobu Gondoh, Ebina (JP); Shinji Nohsho, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 258 days.

(21) Appl. No.: 12/043,407

(22) Filed: Mar. 6, 2008

(65) Prior Publication Data

US 2008/0219694 A1 Sep. 11, 2008

(30) Foreign Application Priority Data

Mar. 8, 2007 (JP) ..... 2007-058682

(51) Int. Cl.
*G03G 21/20* (2006.01)

(52) U.S. Cl. ..... 399/92

(58) Field of Classification Search ..... 399/92, 399/93, 98, 100, 170; 377/140
See application file for complete search history.

(56) References Cited

U.S. PATENT DOCUMENTS

| | | | | |
|---|---|---|---|---|
| 5,147,751 | A | 9/1992 | Kojima et al. | |
| 5,408,298 | A * | 4/1995 | Fukami et al. | 399/159 |
| 6,879,799 | B2 | 4/2005 | Nohsho et al. | |
| 7,267,916 | B2 | 9/2007 | Sugino et al. | |
| 7,314,693 | B2 | 1/2008 | Ikegami et al. | |
| 7,512,355 | B2 * | 3/2009 | Fujii et al. | 399/92 |
| 2006/0269323 | A1 | 5/2006 | Kabata et al. | |
| 2007/0019989 | A1 | 1/2007 | Nakamori | |
| 2007/0059618 | A1 | 3/2007 | Kurimoto et al. | |
| 2007/0287083 | A1 | 6/2007 | Gondoh et al. | |

FOREIGN PATENT DOCUMENTS

| | | |
|---|---|---|
| JP | 53-133444 | 11/1978 |
| JP | 55-157748 | 12/1980 |
| JP | 57-30846 | 2/1982 |
| JP | 2-4275 | 1/1990 |
| JP | 4-281461 | 10/1992 |
| JP | 4-281464 | 10/1992 |
| JP | 2002-296987 | 10/2002 |
| JP | 2003-50477 | 2/2003 |
| JP | 2004-233955 | 8/2004 |
| JP | 2004-264788 | 9/2004 |
| JP | 3624706 | 12/2004 |

* cited by examiner

*Primary Examiner*—David P Porta
*Assistant Examiner*—Kiho Kim
(74) *Attorney, Agent, or Firm*—Oblon, Spivak, McClelland, Maier & Neustadt, L.L.P.

(57) ABSTRACT

An image forming apparatus and a process cartridge have high-durability and stably form high quality images under long-term use without reducing image density even when concentration of discharge products at the surface of an electrophotographic photoconductor becomes uneven in a discharge region of a charging unit. The apparatus employs an image forming method and has a corona discharge type charging unit discharging in a non-contact manner, the photoconductor placed to face the charging unit and the outermost surface layer thereof contains a filler and an amine compound with a specific structure, and an airflow adjusting device which carries air taken from the outside of the apparatus to the vicinity of the charging unit or the photoconductor so that ozone concentration and unevenness thereof are maintained at an average of 30 ppm or less and 15 ppm or less respectively at the surface of the photoconductor in the discharge region.

15 Claims, 7 Drawing Sheets

IMAGE FORMING APPARATUS, IMAGE FORMING METHOD, AND PROCESS CARTRIDGE

BACKGROUND OF THE INVENTION

1. Field of the Invention

The present invention relates to an image forming apparatus, an image forming method and a process cartridge, which achieve high durability and high-quality image.

2. Description of the Related Art

Recent developments in information processing systems using an electrophotographic process are remarkable. In particular, laser printers and digital copiers that record information with a laser beam by converting information into digital signals have been remarkably improved in terms of their print quality and reliability. These laser printers and digital copiers have been combined with high-speed technologies. As a result, they have become used as laser printers and digital copiers capable of full-color printing. With the above-mentioned background, as required functions for an electrophotographic photoconductor (hereinafter, may be referred to as "photoconductor"), it is particularly important to satisfy both high-quality image formation and high-durability.

Typically, as photoconductors used for such laser printers and digital copiers and the like using an electrophotographic process, those using an organic photosensitive material are widely used because of the low manufacturing costs, productivity, environmental safety and the like. These organic photoconductors (OPCs) are broadly classified into the following types: for example, (1) photoconductors using a photoconductive resin typified by polyvinyl carbazole (PVK); (2) photoconductors using a charge transporting complex typified by PVK-TNF (2,4,7-trinitrofluorenone); (3) pigment-dispersed type photoconductors using a pigment typified by a phthalocyanine-binder; and (4) function-separated photoconductors each formed with a combination of a charge generating layer containing a charge generating material and a charge transporting layer containing a charge transporting material.

However, an organic photoconductor (OPC) is easily exfoliated from its photosensitive layer in repetitive use. Acceleration of such exfoliation of the photosensitive layer easily causes a reduction in charge potential of the photoconductor, degradation of photosensitivity and further acceleration of background smear due to flaws and defects of the photoconductor surface, a reduction in image density and degradation in image quality. Providing frictional resistance to photoconductors has been a significant conventional issue to achieve. Further, in recent years, smaller diameter of photoconductors resulting from achieving higher-speed performance and down-sizing of image forming apparatuses leads imparting high-durability to photoconductors to a further more significant issue to achieve.

As a method of achieving a highly durable photoconductor, various methods have been widely known, for example, a protective layer is formed as the outermost surface of a photoconductor, and lubricating property is provided to the protective layer, the protective layer is hardened or a filler is added to the protective layer. In particular, the method of adding a filler to a protective layer is one of effective methods to make a photoconductor have high-durability (see, for example, Japanese Patent Application Laid-Open (JP-A) Nos. 53-133444, 55-157748, 57-30846, 2-4275, 4-281461 and 2000-66434).

However, when a filler is added to the protective layer, the outermost surface of a photoconductor, to obtain high-durability, a residual potential on the photoconductor is likely to increase, and image blur easily occurs due to an oxidizing gas. For achieving high-quality image formation, problems to solve still remain.

Recently, color image forming apparatuses using a roller type charging unit, which has an electric power saving effect, exhibits less ozone generation and allows for achieving its construction capable of downsizing, are mainly used. However, to obtain further higher-durability and higher-speed performance, a corona discharge type charging unit using a non-contact type electrode, which has been conventionally used, is reviewed. However, a corona discharge type charging unit exhibits much more amount of discharge products (e.g., ozone and $NO_x$) generated by discharge electricity than that of a roller type charging unit, and when a photoconductor containing a filler in the outermost surface layer thereof is used to obtain high-durability, the electrical resistance is reduced on the surface of the photoconductor by the discharge products adhered and absorbed to the surface of the photoconductor. Thus, image blur is likely to be caused.

These color image forming apparatuses employ a plurality of image forming units (tandem system) to further achieve high-speed performance. However, when a corona discharge type charging unit is used together, discharge current increases, thereby further increasing the amount of the discharge products (e.g., Ozone and $No_x$). To reduce the concentration of the discharge products in the atmosphere around the photoconductor, airflow around the charging unit has been controlled, for example (See JP-A No. 2002-296987). However, in view of down-sizing the image forming apparatus, an enough space cannot be obtained for an airflow pathway. Thus, although it has been possible to reduce the average concentration of the discharge products to a certain degree in the vicinity of the charging unit, it has been difficult to uniformly reduce the concentration of the discharge products in the image forming region. Unevenness of the concentration of the discharge products in the image forming region causes unevenness of the halftone image density in accordance with the unevenness of the concentration of the discharge products upon repetitive image forming. The extreme unevenness may cause partial image blur.

Further, to achieve higher-quality of images, an image forming apparatus equipped with a lubricant applying unit which is configured to apply a lubricant over the surface of an electrophotographic photoconductor to reduce the friction coefficient has been proposed in JP-A No. 2003-50477 for the purposes of reducing character dropout and transfer nonuniformity of solid parts and of improving cleaning ability by means of a cleaning blade.

Such an image forming apparatus equipped with a lubricant applying unit has other advantages in that abrasion loss of the surface of the photoconductor and occurrence of photoconductor filming can be reduced, thereby allowing for achieving longer operating life of the photoconductor. Further, when such an image forming apparatus is used in combination with a photoconductor containing a filler at the outermost surface thereof for obtaining higher-durability, abrasion wear caused by a variation in the amount of a lubricant applied by means of the lubricant applying unit can be reduced and the flaw resistance of the photoconductor surface is enhanced, and thus the use of the combination enables further higher durability than in a photoconductor containing no filler at the outermost surface layer.

However, when a lubricant is applied over the surface of an electrophotographic photoconductor, oxidizing gases and oxidizing materials generated from a charging unit and a transferring unit are adsorbed to the lubricant, in addition, when used under a high-humidity condition, the photoconductor surface becomes to have low resistance by the effect of moisture, and image blur may often occur. When the charging unit uses a corona discharge process, oxidizing gases and oxidizing materials adhere or accumulates inside the corona charging unit, and the oxidizing gases and oxidizing materials fall on the photoconductor during stoppage in operation of the photoconductor, and the photoconductor surface with the lubricant applied thereon becomes extremely low resistance, resulting in missing image data and reproducing no image data.

In conclusion, the amount of discharge products (e.g., Ozone, $NO_x$ and $SO_x$) generated by the corona discharge type charging unit is greater than that of the roller type charging unit. Further, it is difficult to reduce the unevenness of the concentration of the discharge products in an image forming region in tandem color image forming apparatus. Thus, when the photoconductor, which has the outermost surface layer containing a filler, is employed to achieve high-durability, a latent electrostatic image formed by dots upon repetitive use is slightly moved to the surface and the dots become smaller. As a result, it is likely to cause a reduction in image density and further image blur. Thus, there are not enough effects to the discharge products produced by the corona discharging type charging unit. Therefore, there is still a problem to further enhance high-speed performance, high-durability and high image quality.

BRIEF SUMMARY OF THE INVENTION

The present invention is proposed in view of the present situation and aims to overcome the various conventional problems and to achieve the following objects. It is an object of the present invention to provide an image forming apparatus and a cartridge, which have high-durability and are enabled to suppress image degradation caused by a reduction in image density upon repetitive use when the concentration of discharge products becomes uneven on the surface of an electrophotographic photoconductor in the vicinity of a corona discharging type charging unit (a discharge region of an image forming area of the charging unit) which discharges in a non-contact manner. Therefore, the image forming apparatus and the process cartridge are enabled to stably form a high quality image without image blur, image deletion or unevenness of the halftone image density even when repetitively used for long hours. It is also an object of the present invention to provide an image forming method employed by the image forming apparatus and the cartridge.

As previously mentioned, to achieve a highly durable electrophotographic photoconductor, it is effective that a filler is added to the outermost surface layer of a photoconductor. However, there are problems that this causes an increase in residual potential on the photoconductor and image degradation such as image blur. Specifically, in the photoconductor, which has the outermost surface layer containing a filler, oxidizing gases such as ozone and NOx generated depending on use condition are likely to be adhered to the filler or the like. Thus, the electrical resistance of the outermost surface has been occasionally reduced by repetitive use. Therefore, it may cause image deletion, image blur, or the like.

To overcome the problems described above, the inventors of the present invention have studied and investigated countermeasures and have obtained the findings described hereinafter. An image forming apparatus is constituted by at least a corona discharge type charging unit and an electrophotographic photoconductor, which are placed to face each other. The corona discharge type charging unit discharges in a non-contact manner, and the electrophotographic image conductor has the outermost surface layer containing a filler. In this image forming apparatus, when the outermost surface layer contains a filler and a compound represented by any one of General Formulas (1) and (2), it is possible to prevent the effect of the oxidizing gases, thereby reducing the occurrence of image blur or the like. Besides, an airflow adjusting device is provided in an image forming apparatus. By using the device, air is taken from the outside of the apparatus. Then, the air is carried to a charging unit or an electrophotographic conductor which are placed to face each other. Finally, the air is exhausted to the outside of the apparatus. As a result, the ozone concentration is maintained at an average of 30 ppm, and the unevenness of the concentration is maintained at 15 ppm or less or less at the surface of the electrophotographic photoconductor (in the discharge region of an image forming region of the discharging unit). Thus, it is possible to achieve high-durability, suppress image blur caused by the photoconductor and image degradation caused by image blur and unevenness (reduction) of image density due to unevenness of the concentration of the discharge products generated by the charging unit upon repetitive use, and stably form a high quality image even when the apparatus is repetitively used for long hours.

General Formula (1)

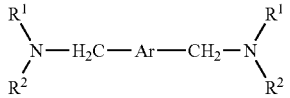

In General Formula (1), $R^1$ and $R^2$ may be identical to each other or different from each other, represent any one of an alkyl group that may have a substituent group and an aryl group that may have a substituent group, at least one of the $R^1$ and $R^2$ is an aryl group that may have a substituent group, the $R^1$ and $R^2$ may be combined to each other to form a heterocyclic ring containing a nitrogen atom, and the heterocyclic ring may be further substituted by a substituent group; and Ar represents an aryl group that may have a substituent group.

General Formula (2)

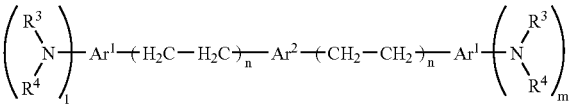

In General Formula (2), $R^3$ and $R^4$ may be identical to each other or different from each other, represent an unsubstituted alkyl group or an alkyl group substituted by an aromatic hydrocarbon group, the $R^3$ and $R^4$ may be combined to each other to form a heterocyclic ring containing a nitrogen atom, and the heterocyclic ring may be further substituted by a substituent group; $Ar^1$ and $Ar^2$ represent an aryl group that may have a substituent group; "l" and "m" represent an integer of 0 to 3, and both of the "l" and "m" cannot be an integer of 0 (zero) at the same time; and "n" is an integer of 1 or 2.

The reason that it is effective to add a compound represented by any one of General Formulas (1) and (2) to the surface is not clear at this time. However, it is assumed that an amino substituent included in the structure effectively suppress oxidizing gases generating radical substances. Moreover, since a compound represented by any one of General Formulas (1) and (2) has charge transporting property, the compound itself does not function as a charge carrier. Therefore, degradation in electrical property such as an increase in residual potential along with the addition does not occur in a great degree.

High-speed color image forming apparatus (especially in tandem type), which employs a corona discharge type charging unit together, requires further charging capacity in the charging unit and thus further increases the amount of discharge current, thereby generating more amount of oxidizing gases. In addition, since the image forming apparatus is small, the oxidizing gases cannot sufficiently be exhausted to the outside of the apparatus, the photoconductor is exposed to high concentration of the oxidizing gases. Thus, it is difficult to prevent image deletion or image blur simply by adding the compound represented by any one of General Formulas (1) and (2) to the outermost surface layer of the photoconductor.

Moreover, when the ozone concentration, an indicator of the concentration of the oxidizing gases generated by the charging unit, varies or becomes uneven in an image forming area, the photoconductor is exposed to different amount of the oxidizing gases in accordance with the unevenness of the ozone concentration. Therefore, a half tone image density is likely to lack uniformity upon repetitive use.

To overcome the problems described above, the inventors of the present invention further studied and investigated countermeasures and have obtained the findings as previously mentioned. A compound represented by any one of General Formulas (1) and (2) is added to the outermost surface of the photoconductor, and an airflow adjusting device is provided to exhaust the air to the outside of the image forming apparatus. Thus, the average ozone concentration is maintained at 30 ppm or less at the surface of the photoconductor in the discharge region of the charging unit, which is an image forming area of the charging unit. In addition, unevenness of the ozone concentration is maintained at 15 ppm or less. Therefore, it is possible to prevent image blur, image deletion and unevenness of the halftone image density.

The ozone concentration is maintained in a predetermined range described above at the surface of the photoconductor in the discharge region of the charging unit by methods described below, for example.

(I) Air is taken from the outside of the image forming apparatus. The air is then carried to the electrophotographic photoconductor, which is placed to face the charging unit, from the back of the charging unit through the inside of the charging unit. Finally, the air is exhausted to the outside of the image forming apparatus from a gap between the charging unit and the electrophotographic photoconductor.

(II) The air adjusting device takes air from the outside of the image forming apparatus and carries the air to the back of the charging unit from the gap between the charging unit and the electrophotographic photoconductor, which are placed to face each other, through the inside of the charging unit. Finally, the air adjusting device exhausts the air to the outside of the image forming apparatus from the back of the charging unit.

More specific examples are as follows:

(III) Air is taken from the outside of the image forming apparatus by using at least one fan. The air is carried to in order of a first duct, the inside of the charging unit and a second duct. Finally, the air is exhausted using at least one fan to the outside of the image forming apparatus.

(IV) Air is taken from the outside of the image forming apparatus by using at least two fans. The air taken is carried to in order of two corresponding ducts, the inside of the charging unit and other two corresponding ducts. Finally, the air is exhausted using at least two fans to the outside of the image forming apparatus. In this method, quantity of the airflow from these four fans is controlled, thereby maintaining the ozone concentration at an average of 30 ppm or less and the unevenness of the ozone concentration at 15 ppm or less at the surface of the electrophotographic photoconductor in the discharge region of the charging unit.

By using any of the methods described above, the average ozone concentration is maintained at 30 ppm or less at the surface of the photoconductor in the discharge area of the charging unit, and the unevenness of the ozone concentration is maintained at 15 ppm or less. Thus, it is possible to prevent image deletion, blur and unevenness of halftone image density.

When the ozone concentration exceeds 30 ppm, it is likely to cause image deletion or image blur although a compound represented by any one of General Formulas (1) and (2) is added to the outermost surface layer of the photoconductor. When the unevenness of the ozone concentration exceeds 15 ppm, it is likely to cause unevenness of halftone image density upon repetitive use.

Compounds disclosed in JP-A Nos. 2004-233955 and 2004-264788 may be used as compounds represented by any one of General Formulas (1) and (2) in the present invention.

The present invention is based on the above-described findings, and the invention according to (1) to (15) described below overcome the aforementioned problems. Hereinafter, the present invention will be described in detail.

(1) An image forming apparatus includes a corona discharge type charging unit which discharges in a non-contact manner; an electrophotographic photoconductor which has an outermost surface layer containing a filler; and an airflow adjusting device which takes air from an outside of the image forming apparatus, carries the air to a vicinity of any one of the charging unit and the electrophotographic photoconductor and exhausts the air to the outside of the image forming apparatus, wherein the charging unit and the electrophotographic photoconductor are placed to face each other, the airflow adjusting device maintains ozone concentration at an average of 30 ppm or less and unevenness of the ozone concentration at 15 ppm or less at a surface of the electrophotographic photoconductor in a discharge region in an image forming area of the charging unit, and the outermost surface layer of the electrophotographic photoconductor contains a compound represented by any one of the following General Formulas (1) and (2), General Formula (1)

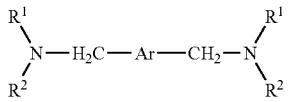

where $R^1$ and $R^2$ may be identical to each other or different from each other, represent any one of an alkyl group that may have a substituent group and an aryl group that may have a substituent group, at least one of the $R^1$ and $R^2$ is the aryl group that may have the substituent group, the $R^1$ and $R^2$ may be combined to each other to form a heterocyclic ring containing a nitrogen atom, and the heterocyclic ring may be further substituted by a substituent group; and Ar represents an aryl group that may have a substituent group, General Formula (2)

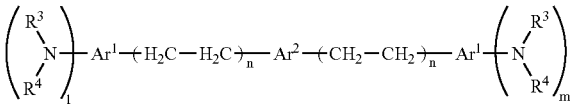

where $R^3$ and $R^4$ may be identical to each other or different from each other, represent an unsubstituted alkyl group or an alkyl group substituted by an aromatic hydrocarbon group, the $R^3$ and $R^4$ may be combined to each other to form a heterocyclic ring containing a nitrogen atom, and the heterocyclic ring may be further substituted by a substituent group; $Ar^1$ and $Ar^2$ represent an aryl group that may have a substituent group; "l" and "m" represent an integer of 0 to 3, and both of the "l" and "m" cannot be an integer of 0 (zero) at the same time; and "n" is an integer of 1 or 2.

(2) In the image forming apparatus according to item (1), the airflow adjusting device includes a unit which takes the air from the outside of the image forming apparatus, carries the air to the electrophotographic photoconductor from a back of the charging unit through an inside of the charging unit, exhausts the air to the outside of the image forming apparatus from a gap between the charging unit and the electrophotographic photoconductor and maintains the ozone concentration at the average of 30 ppm or less and the unevenness of the ozone concentration at 15 ppm or less at the surface of the image forming apparatus in the discharge region of the image forming area of the charging unit.

(3) In the image forming apparatus according to item (1), the airflow adjusting unit includes a unit which takes air from the outside of the image forming apparatus, carries the air to a back of the charging unit from a gap between the charging unit and the electrophotographic photoconductor through an inside of the charging unit, exhausts the air to the outside of the image forming apparatus from the back of the charging unit and maintains the ozone concentration at the average of 30 ppm or less and the unevenness of the ozone concentration at 15 ppm or less at the surface of the image forming apparatus in the discharge region of the image forming area of the charging unit.

(4) In the image forming apparatus according to any one of items (2) and (3), the airflow adjusting device includes a unit which takes the air from the outside of the image forming apparatus by using at least one fan, carries the air to the inside of the charging unit from any one of the back of the charging unit and the gap between the charging unit and the electrophotographic photoconductor through a first duct, exhausts the air to the outside of the image forming apparatus through a second duct by using at least one fan and maintains the ozone concentration at the average of 30 ppm or less and the unevenness of the ozone concentration at 15 ppm or less at the surface of the image forming apparatus in the discharge region of the image forming area of the charging unit.

According to any one of the image forming apparatus (2) to (4), ozone concentration, an indicator of the oxidizing gas concentration, is effectively reduced, and the concentration does not vary or become uneven in the image forming area, thereby overcoming the problems such as image blur, image deletion and unevenness of the halftone image density. For example, it is possible to stably form a high-quality image upon repetitive use in high-speed or full-color printing.

(5) In the image forming apparatus according to any one of items (1) to (4), the filler contains at least one selected from metal oxides.

It is very effective to utilize a metal oxide because it has high electrical insulating property and high thermostability and improves frictional resistance.

(6) In the image forming apparatus according to any one of items (1) to (5), the filler has the average primary particle diameter of 0.01 μm to 1.0 μm.

By having the particles diameter in the range described above, a reduction in frictional resistance, dispersibility or the like is avoided. In addition, sendimentary property of the filler is suppressed, thereby preventing toner filming.

(7) In the image forming apparatus according to any one of items (1) to (6), the filler content of the outermost surface layer is 5% by mass to 50% by mass.

By having the filler content in the range described above, frictional resistance is retained, thereby maintaining the transparency of the outermost surface layer.

(8) In the image forming apparatus according to any one of items (1) to (7), the outermost surface layer of the electrophotographic photoconductor contains an organic compound having an acidic value of 10 mgKOH/g to 700 mgKOH/g.

When the outermost surface layer contains the organic compound having an acidic value of 10 mgKOH/g to 700 mgKOH/g, it is possible to suppress an increase in residual potential and stably form high quality image even when the apparatus is used for long hours.

(9) In the image forming apparatus according to any one of items (1) to (8), the electrophotographic photoconductor has a substrate, a photosensitive layer and a protective layer formed in this order on the substrate, and the protective layer is the outermost surface layer.

The above configuration is particularly preferable when combined with an airflow adjusting device provided in the image forming apparatus of the present invention, in which the corona discharging type charging unit discharging in a non-contact manner is placed to face the electrophotographic photoconductor. Consequently, it is possible to form a high quality image without image blur, image deletion or unevenness of halftone image density.

(10) The image forming apparatus according to any one of items (1) to (9) further includes an exposing unit, and the exposing unit is any one of a laser diode (LD) and a light emitting diode (LED), wherein the exposing unit digitally writes a latent electrostatic image on the electrophotographic photoconductor.

The exposing unit, which digitally writes a latent electrostatic image on the electrophotographic photoconductor, can be utilized in the latest information processing systems such as laser printers and digital copiers which perform high-speed or/and full-color printing.

(11) In the image forming apparatus according to any one of items (1) to (10), visual images with a plurality of colors are sequentially superimposed on the electrophotographic photoconductor to form a color image.

With the above configuration, it is possible to perform full-color printing without image blur, image deletion or unevenness of halftone image density upon repetitive use.

(12) The image forming apparatus according to any one of items (1) to (11) includes a plurality of electrophotographic photoconductors, wherein monochrome visual images with a plurality of colors developed on the respective electrophotographic photoconductors are sequentially superimposed to form a color image.

By the above configuration, full-color printing is enabled without image blur, image deletion, or unevenness of halftone image density upon high-speed repetitive use.

(13) The image forming apparatus according to any one of items (1) to (12) further includes an intermediate transferring unit configured to primarily transfer a visual image developed on the electrophotographic photoconductor to an intermediate transfer member and then secondarily transfer the visual image on the intermediate transfer member onto a recording medium, wherein visual images in a plurality of colors are sequentially superimposed on the intermediate transfer member to form a color image, and the color image is secondarily transferred onto the recording medium at a time.

By the above configuration, high resolution full-color printing is enabled without image blur, image deletion, or unevenness of the halftone image density upon further high-speed repetitive use.

(14) An image forming method includes repetitive steps of charging, exposing, developing, and transferring by using an image forming apparatus, wherein the image forming apparatus includes: a corona discharge type charging unit which discharges in a non-contact manner; an electrophotographic photoconductor which has an outermost surface layer containing a filler; and an airflow adjusting device which takes air from an outside of the image forming apparatus, carries the air to a vicinity of any one of the charging unit and the electrophotographic photoconductor and exhausts the air to the outside of the image forming apparatus, and wherein the charging unit and the electrophotographic photoconductor are placed to face each other, the airflow adjusting device maintains ozone concentration at an average of 30 ppm or less and unevenness of the ozone concentration at 15 ppm or less at a surface of the electrophotographic photoconductor in a discharge region in an image forming area of the charging unit, and the outermost surface layer of the electrophotographic photoconductor contains a compound represented by any one of the following General Formulas (1) and (2), General Formula (1)

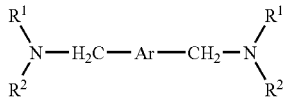

where $R^1$ and $R^2$ may be identical to each other or different from each other, represent any one of an alkyl group that may have a substituent group and an aryl group that may have a substituent group, at least one of the $R^1$ and $R^2$ is the aryl group that may have the substituent group, the $R^1$ and $R^2$ may be combined to each other to form a heterocyclic ring containing a nitrogen atom, and the heterocyclic ring may be further substituted by a substituent group; and Ar represents an aryl group that may have a substituent group, General Formula (2)

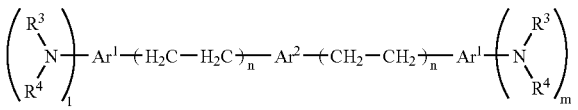

where $R^3$ and $R^4$ may be identical to each other or different from each other, represent an unsubstituted alkyl group or an alkyl group substituted by an aromatic hydrocarbon group, the $R^3$ and $R^4$ may be combined to each other to form a heterocyclic ring containing a nitrogen atom, and the heterocyclic ring may be further substituted by a substituent group; $Ar^1$ and $Ar^2$ represent an aryl group that may have a substituent group; "l" and "m" represent an integer of 0 to 3, and both of the "l" and "m" cannot be an integer of 0 (zero) at the same time; and "n" is an integer of 1 or 2.

(15) A process cartridge used in the image forming apparatus in any one of items (1) to (14) is provided with the electrophotographic photoconductor and at least one selected from a charging unit, an exposing unit, a developing unit, a transferring unit, a cleaning unit and a charge eliminating unit.

The image forming apparatus of the present invention has the corona discharge type charging unit and the electrophotographic photoconductor and is provided with an airflow adjusting device. The corona discharging type charging unit discharges in a non-contact manner, and the electrophotographic photoconductor has the outermost surface layer containing the filler. The airflow adjusting device maintains the average ozone concentration at 30 ppm or less and unevenness of the ozone concentration at 15 ppm or less at the surface of the electrophotographic photoconductor. This image forming apparatus of the present invention has high-durability. In the image forming apparatus, unevenness of the discharge product concentration is controlled in a predetermined range at the surface of the electrophotographic photoconductor in the vicinity of the corona discharging type charging unit discharging in a non-contact manner. Thus, it is possible to suppress image degradation caused by a reduction in the image density upon repetitive use and to stably form a high quality image without image blur, image deletion, or halftone image density when the apparatus is repetitively used for long hours (e.g., high-speed or/and full-color printing).

According to the image forming method of the present invention, it is possible to stably form a high quality image when the apparatus is repetitively used for long hours because image formation is performed by the image forming apparatus.

According to a process cartridge of the present invention, since the process cartridge is installed in the image forming apparatus, it is possible to stably form a high quality image when the apparatus is repetitively used for long hours. In addition, the process cartridge has a configuration with highly relative position precision since a member of each processing unit and the electrophotographic photoconductor are integrated. Therefore, it is possible to improve image quality and maintenance. As a result, manufacturing cost can be reduced.

DETAILED DESCRIPTION OF THE INVENTION

Figure 1:
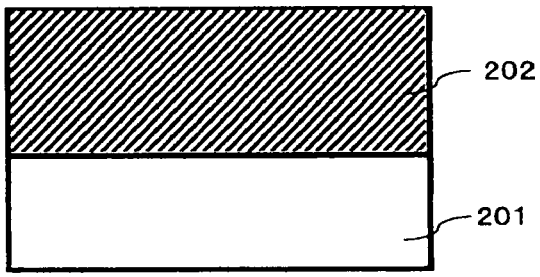
FIG. 1 is a cross-sectional view schematically showing one example of a single-layered electrophotographic photoconductor of the present invention.

Image Forming Apparatus and Image Forming Method

As previously mentioned, an image forming apparatus includes a corona discharge type charging unit which discharges in a non-contact manner; an electrophotographic photoconductor which has an outermost surface layer containing a filler; and an airflow adjusting device which takes air from an outside of the image forming apparatus, carries the air to a vicinity of any one of the charging unit and the electrophotographic photoconductor and exhausts the air to the outside of the image forming apparatus, wherein the charging unit and the electrophotographic photoconductor are placed to face each other, the airflow adjusting device maintains ozone concentration at an average of 30 ppm or less and unevenness of the ozone concentration at 15 ppm or less at a surface of the electrophotographic photoconductor in a discharge region in an image forming area of the charging unit, and the outermost surface layer of the electrophotographic photoconductor contains a compound represented by any one of General Formulas (1) and (2).

Specifically, the image forming apparatus of the present invention is equipped with at least an electrophotographic photoconductor, a charging unit, an exposing unit, a developing unit, a transferring unit, a cleaning unit and an airflow adjusting device. The airflow adjusting device carries air taken from the outside of the apparatus to the vicinity of the charging unit or the electrophotographic photoconductor and then exhausts the air to the outside of the apparatus. The charging unit and the electrophotographic photoconductor are placed to face each other. The image forming apparatus may be further equipped with other units such as a fixing unit, a charge-eliminating unit, a lubricant applying unit, a recycling unit and a controlling unit.

An image forming method includes repetitive steps of charging, exposing, developing, and transferring by using an image forming apparatus, wherein the image forming apparatus includes: a corona discharge type charging unit which discharges in a non-contact manner; an electrophotographic photoconductor which has an outermost surface layer containing a filler; and an airflow adjusting device which takes air from an outside of the image forming apparatus, carries the air to a vicinity of any one of the charging unit and the electrophotographic photoconductor and exhausts the air to the outside of the image forming apparatus, and wherein the charging unit and the electrophotographic photoconductor are placed to face each other, the airflow adjusting device maintains ozone concentration at an average of 30 ppm or less and unevenness of the ozone concentration at 15 ppm or less at a surface of the electrophotographic photoconductor in a discharge region in an image forming area of the charging unit, and the outermost surface layer of the electrophotographic photoconductor contains a compound represented by any one of General Formulas (1) and (2).

Specifically, the image forming method of the present invention includes at least a charging step, an exposing step, a developing step, a transferring step and a cleaning step. The image forming method may further include other steps such as a fixing step, a charge-eliminating step, a lubricant applying step, a recycling step and a controlling step in accordance with necessity.

The image forming method of the present invention can be favorably carried out using the image forming apparatus of the present invention. The charging step can be carried out using the charging unit. The exposing step can be carried out using the exposing unit. The developing step can be carried out using the developing unit. The transferring step can be carried out using the transferring unit. The cleaning step can be carried out using the cleaning unit. Other steps can be carried out using other units.

The electrophotographic photoconductor used in the image forming apparatus and the image forming method of the present invention will be described in detail below.

<Electrophotographic Photoconductor>

The layer configuration of the electrophotographic photoconductor is not particularly limited and may be suitably selected in accordance with the intended use. A first embodiment of the electrophotographic photoconductor of the present invention has a photosensitive layer that is formed in a single-layer (hereinafter, may be referred to as "single-layered photosensitive layer") on a substrate and further has other layers such as a protective layer and an undercoat layer in accordance with necessity. Further, a second embodiment of the electrophotographic photoconductor has a substrate, a photosensitive layer in which a charge generating layer and a charge transporting layer are multi-layered (hereinafter, may be referred to as "multi-layered photosensitive layer") and other layers such as a protective layer and an undercoat layer in accordance with necessity. In the second embodiment of the present invention, the charge generating layer and the charge transporting layer may be formed in a reverse order.

Herein, the electrophotographic photoconductor of the present invention will be explained with reference to the drawings. Each of FIGS. 1 to 5 is a cross-sectional view schematically showing one example of the electrophotographic photoconductor of the present invention. The electrophotographic photoconductor shown in FIG. 1 has a substrate 201 and a photosensitive layer 202 thereon. The photosensitive layer 202 contains a charge generating material and a charge transporting material. The photosensitive layer 202 also contains a filler and a compound represented by any one of General Formulas (1) and (2).

Figure 2:
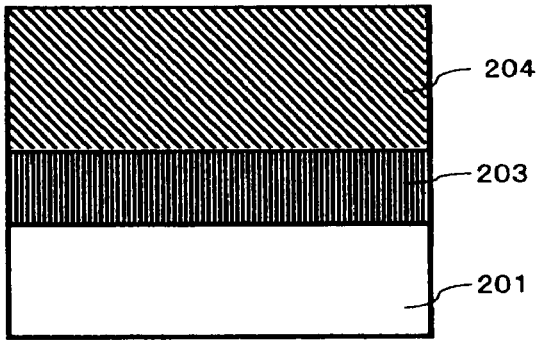
FIG. 2 is a cross-sectional view schematically showing one example of a multi-layered electrophotographic photoconductor of the present invention.

In an electrophotographic photoconductor shown in FIG. 2, a charge generating layer 203 and a charge transporting layer 204 are multi-layered on a substrate 201. The charge generating layer 203 contains a charge generating material, and the charge transporting layer 204 contains a charge transporting material. The charge transporting layer 204 also contains a filler and a compound represented by any one of General Formulas (1) and (2).

Figure 3:
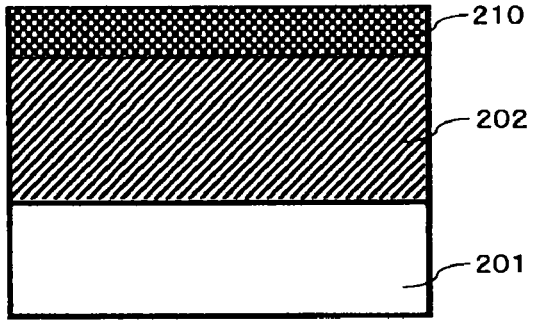
FIG. 3 is a cross-sectional view schematically showing another example of the single-layered electrophotographic photoconductor of the present invention.

An electrophotographic photoconductor shown in FIG. 3 has a substrate is 201 and a photosensitive layer 202 thereon. The photosensitive layer 202 contains a charge generating material and a charge transporting material. The electrophotographic photoconductor further has a protective layer 210 on the surface of the photosensitive layer 202. The protective layer 210 contains a filler and a compound represented by any one of General Formulas (1) and (2).

Figure 4:
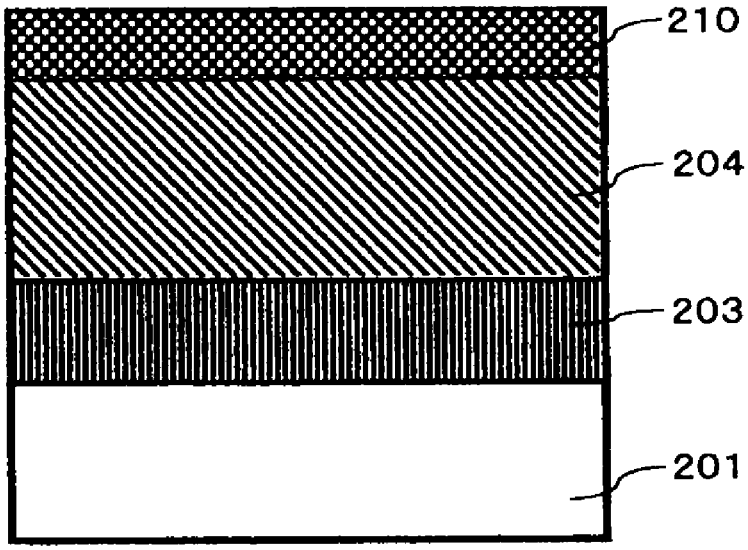
FIG. 4 is a cross-sectional view schematically showing still another example of the multi-layered electrophotographic photoconductor of the present invention.

In an electrophotographic photoconductor shown in FIG. 4, a charge generating layer 203 and a charge transporting layer 204 are multi-layered on a substrate 201. The charge generating layer 203 contains a charge generating material, and the charge transporting layer 204 contains a charge transporting material. A protective layer 210 is further formed on the surface of the charge transporting layer 204. The protective layer 210 contains a filler and a compound represented by any one of General Formulas (1) or (2).

Figure 5:
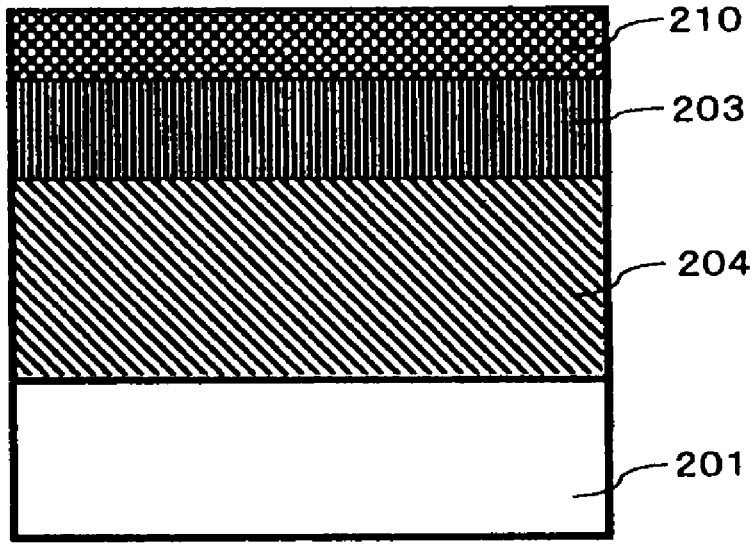
FIG. 5 is a cross-sectional view schematically showing still yet another example of the multi-layered electrophotographic photoconductor of the present invention.

In an electrophotographic photoconductor shown in FIG. 5, a charge transporting layer 204 and a charge generating layer 203 are multi-layered on a substrate 201. The charge transporting layer 204 contains a charge transporting material, and the charge generating layer 203 contains a charge generating material. A protective layer 210 is further formed on the surface of the charge generating layer 203. The protective layer 210 contains a filler and a compound represented by any one of General Formulas (1) or (2).

A charge transporting layer, a protective layer, or the like can be the outermost surface layer of the multi-layered photoconductor. A photosensitive layer, a protective layer, or the like can preferably be the outermost surface is layer of the single-layered photoconductor. Of these, the following embodiment is particularly preferable: the electrophotographic photoconductor has a substrate, a charge generating layer, a charge transporting layer and a protective layer; the charge generating layer, the charge transporting layer and the protective layer are formed in this order on the substrate; and the outermost surface layer is the protective layer.

The outermost surface layer of the electrophotographic photoconductor contains at least a filler and a compound represented by any one of General Formulas (1) and (2) and further contains other components in accordance with necessity.

—Filler—

For the filler, an organic filler or an inorganic filler is used. Examples of the organic filler include fluorine resin powders, which are composed of polytetrafluoroethylene or the like, silicone resin powders and a carbon powders. Examples of the inorganic filler include metal powders composed of such as copper, tin, aluminum and indium; metal oxides such as silica, tin oxide, zinc oxide, titanium oxide, alumina, zirconium oxide, indium oxide, antimony oxide, bismuth oxide, calcium oxide, tin oxide doped with antimony, and indium oxide doped with tin; metal fluorides such as tin fluoride, calcium fluoride and aluminum fluoride; potassium titanates and boron nitrides. Of these, it is advantageous to use an organic filler in terms of hardness of a used filler for the purpose of improving abrasion resistance of the photoconductor.

Further, it is preferable to use a filler having high electrical insulating property because this filler hardly causes image blur. For such a filler, a filler having a pH of 5 or more or a filler having a dielectric constant of 5 or more is particularly effective. Examples of the filler include titanium oxides, aluminas, zinc oxides and zirconium oxides. A filler having a pH of 5 or more or a filler having a dielectric constant of 5 or more may be used alone. Two or more fillers each having a pH of 5 or less and each having a pH of 5 or more may be mixed for use, or two or more fillers each having a dielectric constant of 5 or less and each having a dielectric constant of 5 or more may be mixed for use. Of these fillers, an α-alumina, which has high-electrical insulating property and is highly thermally stable and has a hexagonal close-packed structure, is particularly useful in terms of preventing occurrence of image blur and abrasion resistance.

The filler is preferably subjected to a surface treatment using at least one surface finishing agent, because when the dispersibility of the filler is lowered, it causes not only an increase in residual potential on the photoconductor but also a reduction in transparency of the outermost surface layer and occurrence of coating defects and further causes a reduction in abrasion resistance.

The surface finishing agent is not particularly limited and may be suitably selected from among conventionally used surface finishing agents. However, a surface finishing agent capable of maintaining the electrical is insulating property of the filler is preferable. Examples of such a surface finishing agent include titanate coupling agents, aluminum coupling agents, zircoaluminate coupling agents, higher fatty acids, or compounds prepared with mixtures thereof and silane coupling agent(s); $Al_2O_3$, $TiO_2$, $ZrO_2$, silicone, aluminum stearate or mixtures thereof are more preferable in terms of dispersibility of the filler and preventing occurrence of image blur. An influence of image blur is increased by the surface treatment with the use of the silane coupling agent. However, the influence may be suppressed by mixing the surface finishing agent with a silane coupling agent for use. The use amount of the surface finishing agent varies depending on the average primary particle diameter of the filler used. However, the amount is preferably 3% by mass to 30% by mass and more preferably 5% by mass to 20% by mass. When the use amount of the surface finishing agent is less than 3% by mass, the dispersion effect of the filler cannot be obtained. When the use amount is more than 30% by mass, it may cause an excessive increase in residual potential on the electrophotographic photoconductor.

The average primary diameter of the filler is preferably 0.01 μm to 1.0 μm, and more preferably 0.05 μm to 0.8 μm. When the average particle diameter of the filler is less than 0.01 μm, it may cause a reduction in abrasion resistance, a reduction in dispersibility and the like. When the average particle diameter is more than 1.0 μm, sedimentation property of the filler may be accelerated, and toner filming may occur.

The average particle diameter of the filler can be measured, for example, by visually observing the filler under an electron microscope.

The filler content of the outermost surface layer is preferably 5% by mass to 50% by mass, and more preferably 10% by mass to 40% by mass. When the filler content is less than 5% by mass, the abrasion resistance of the photoconductor is insufficient. When the content is more than 50% by mass, the transparency of the outermost surface layer may be impaired. When a filler is contained in the photosensitive layer surface, the filler can be contained in the entire photosensitive layer. However, in this case, it is preferable that a concentration gradient of the filler be provided so that the outermost surface constituted by the charge transporting layer has the highest concentration and the photosensitive layer at the substrate side has the lowest concentration, or the charge transporting layer is multi-layered and the filler concentration is gradually increased from the substrate side toward the surface side of the photosensitive layer.

—Organic Compound Having Acidic Value of 10 mgKOH/g to 700 mgKOH/g—

In the electrophotographic photoconductor, the outermost surface layer containing a filler allows for achieving high-durability and avoiding occurrence of image blur. However, the residual potential is increased and the influence has increasingly impact on formation of an image. To suppress the increase in residual potential, it is preferable to add an organic compound having an acidic value of 10 mgKOH/g to 700 mgKOH/g Herein, the acidic value is defined by a milligram of a potassium hydrate required to neutralize a free fatty acid contained in 1 gram of a sample and can be measured by the method specified by JIS K2501.

The organic compound having an acidic value of 10 mgKOH/g to 700 mgKOH/g is not particularly limited. Examples of the organic compound include organic fatty acids and resins, which have an acidic value of 10 mgKOH/g to 700 mgKOH/g. However, organic acids such as maleic acid, citric acid, tartaric acid and succinic acid each of which has an extremely low molecular weight and acceptors may drastically reduce the dispersibility of the filler. Thus, with use of the above-mentioned organic fatty acids, the reducing effect of the residual potential may not be sufficiently exerted. Thus, in order to reduce the residual potential of a photoconductor and increase the dispersibility of the filler, it is preferable to use a low-molecular weight polymer, resin and copolymer, and further, to mix them for use. For the structure of the organic compound, the organic compound more preferably has a linear structure with less steric hindrance. To enhance dispersibility of the filler, it is necessary to impart affinity to both the filler and a binder resin used. When a material having large steric hindrance is used, the affinity between the filler and the binder resin is lowered, which leads to occurrence of the various problems mentioned above.

From the above-noted viewpoints, for the organic compound having an acidic value of 10 mgKOH/g to 700 mgKOH/g, a polycarboxylic acid is preferably used. Any organic compounds or derivatives thereof, in which a polymer or a copolymer contains a carboxylic acid, may be used as the polycarboxylic acid. Examples of the organic compounds include polyester resins, acrylic resins, copolymers using an acrylic acid or a methacrylic acid, acrylic resins, and styrene acrylic-copolymers. Each of these organic compounds may be used alone or in combination with two or more. As the case may be, the dispersibility of the filler may be improved by mixing each of these materials and an organic fatty acid(s) for use, or the reducing effect of the residual potential may be increased because of the improved dispersibility of the filler.

The organic compound preferably has an acidic value of 10 mgKOH/g to 700 mgKOH/g and more preferably has an acidic value of 30 mgKOH/g to 400 mgKOH/g. When the acidic value is excessively high, the electric resistivity is excessively reduced, resulting in a large influence of image blur, and when the acidic value is excessively low, the additive amount of the organic compound needs to be increased, and the reducing effect of a residual potential will be insufficient. It is necessary for the acidic value of the organic compound having an acidic value of 10 mgKOH/g to 700 mgKOH/g be determined depending on the additive amount thereof and the composition balance. The use of an organic compound having a higher acidic value necessarily in the same additive amount does not necessarily lead to a higher reducing effect of residual potential. The reducing effect of residual potential is greatly relating to the adsorption property of the organic compound having an acidic value of 10 mgKOH/g to 700 mgKOH/g to the filler.

The content of the organic compound having an acidic value of 10 mgKOH/g to 700 mgKOH/g is determined depending on the acidic value and the content of the filler. Specifically, when the content of the organic compound having an acidic value of 10 mgKOH/g to 700 mgKOH/g is represented by A, the acidic value of the organic compound having an acidic value of 10 mgKOH/g to 700 mgKOH/g is represented by B, and the filler content is represented by C, it is preferable that the following Relational Expression 1 is satisfied.

$$0.2 \leqq \text{acidic value equivalent}(A \times B/C) \leqq 20 \qquad \text{Relational Expression 1}$$

When the content of the organic compound having an acidic value of 10 mgKOH/g to 700 mgKOH/g is excessively high, this has the opposite effect and may cause a dispersion defect and an influence of image blur greatly appears. In contrast, when the content is excessively low, it may cause a dispersion defect and the reducing effect of residual potential may be insufficient.

The filler can be dispersed along with at least an organic solvent and an organic compound having an acidic value of 10 mgKOH/g to 700 mgKOH/g using a ball mill, an attritor, a sand mill, an ultrasonic wave or the like. Of these dispersing devices, it is more preferable to use a ball mill from the perspective that it allows for increasing the contact efficiency between the filler and the organic compound having an acidic value of 10 mgKOH/g to 700 mgKOH/g and causes less amount of impurities mixed from the outside.

For a material of a dispersing medium used, all the conventional materials used for media such as zirconia, alumina and agate can be used. However, alumina is particularly preferable in terms of dispersibility of the filler and the reducing effect of residual potential. The use of zirconia causes a large amount of abrasion of the dispersing medium in the dispersion treatment, and the residual potential is significantly increased by the impurities. Further, the dispersibility of the filler is greatly reduced by the impurities of the abrasion powder and then the sedimentation property of the filler is accelerated. When alumina is used for the dispersing medium, the abrasion amount of the dispersing medium can be kept low and the influence of the entered abrasion powder on the residual potential is extremely small, although the dispersing medium slightly abrades away in the dispersion treatment. Further, even when the abrasion powder gets mixed, it exerts less adverse influence on the dispersibility of the filler. Thus, it is particularly preferable to use alumina for material of the dispersing medium used in the dispersion treatment.

It is preferable that the organic compound having an acidic value of 10 mgKOH/g to 700 mgKOH/g be preliminarily added along with the filler and an organic solvent in a coating solution for the outermost surface layer before the dispersion treatment, because it can prevent the filler from flocculating in the coating solution and can suppress the sedimentation property of the filler. In the meanwhile, a binder resin and a charge transporting material can be added to the coating solution before the dispersion treatment, however, in this case, a is slight reduction in dispersibility of the filler may be observed. For this reason, the binder resin and the charge transporting material are preferably added in a state of being dissolved in an organic solvent to the dispersed coating solution after the dispersion treatment of the filler.

In the organic compound, ozone generated by a corona discharge type charging unit and oxidizing gases such as $NO_x$ easily adsorb thereto, which is derived from the chemical structure thereof. As the case may be, the adsorption of ozone and oxidizing gases may cause a low-electric resistance of the outermost surface layer and problems with image deletion and the like.

In the present invention, to solve this problem, the outermost surface layer contains a compound represented by any one of the following General Formulas (1) and (2).

General Formula (1)

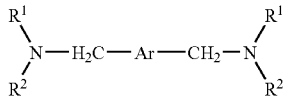

In General Formula (1), $R^1$ and $R^2$ may be identical to each other or different from each other, represent any one of an alkyl group that may have a substituent group and an aryl group that may have a substituent group, at least one of the $R^1$ and $R^2$ is an aryl group that may have a substituent group, the $R^1$ and $R^2$ may be combined to each other to form a heterocyclic ring containing a nitrogen atom, and the heterocyclic ring may be further substituted by a substituent group; and Ar represents an aryl group that may have a substituent group.

General Formula (2)

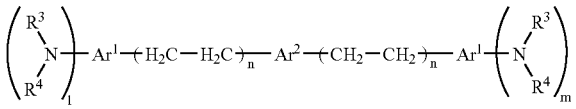

In General Formula (2), $R^3$ and $R^4$ may be identical to each other or different from each other, represent an unsubstituted alkyl group or an alkyl group substituted by an aromatic hydrocarbon group, the $R^3$ and $R^4$ may be combined to each other to form a heterocyclic ring containing a nitrogen atom, and the heterocyclic ring may be further substituted by a substituent group; $Ar^1$ and $Ar^2$ represent an aryl group that may have a substituent group; "l" and "m" represent an integer of 0 to 3, and both of the "l" and "m" cannot be an integer of 0 (zero) at the same time; and "n" is an integer of 1 or 2.

Examples of the alkyl group in General Formula (1) or General Formula (2) include methyl group, ethyl group, propyl group, isopropyl group, butyl group, isobutyl group, sec-butyl group, tertiary t-butyl group, pentyl group, isopentyl group, neopentyl group, hexyl group, heptyl group, octyl group, nonyl group, decyl group, undecyl group, undecanyl group, dodecyl group, vinyl group, benzyl group, phenethyl group, styryl group, cyclopentyl group, cyclohexyl group, cycloheptyl group and cyclohexenyl group.

Examples of the aryl group in General Formula (1) or General Formula (2) include phenyl group, tolyl group, xylyl group, styryl group, naphthyl group, anthryl group and biphenyl group.

Examples of the aromatic hydrocarbon group in General Formula (2) include aromatic ring groups such as benzene, biphenyl, naphthalene, anthracene, fluorene and pyrene; and aromatic heterocyclic groups such as pyridine, quinoline, thiophene, furan, oxazole, oxadiazole and carbazole.

When $R^1$ and $R^2$ or $R^3$ and $R^4$ are combined to form a heterocyclic group containing a nitrogen atom, for the heterocyclic group, condensed heterocyclic groups in each of which an aromatic hydrocarbon group is condensed in a pyrrolidino group, a piperidino group, a piperazino group etc. are exemplified.

Examples of the substituent groups thereof include the specific examples of the alkyl group mentioned above, alkoxy groups such as methoxy group, ethoxy group, propoxy group and buthoxy group; halogen atoms such as fluorine atom, chlorine atom, bromine atom and iodine atom; the above-mentioned aromatic hydrocarbon groups; and heterocyclic groups such as pyrrolidine, piperidine and piperazine.

A diamine compound represented by any one of General Formulas (1) and (2) can be easily produced by the method described in "E. Elce and A. S. Hay, Polymer, Vol. 37 No. 9, 1745 (1996)). Specifically, in General Formula (1), the diamine compound can be produced by reacting a dihalogen compound represented by the following General Formula (a) with a secondary amine compound represented by the following General Formula (b) in the presence of a basic compound at a temperature ranging from room temperature to 100° C. In General Formula (2), the diamine compound can be produced in the same way as described above by reacting the corresponding dihalogen with the corresponding secondary amine compound in the presence of a basic compound.

$XH_2C—Ar—CH_2X$ General Formula (a)

In General Formula (a), Ar represents the same one as represented by General Formula (1), and X represents a halogen atom.

General Formula (b)

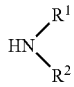

In General Formula (b), $R^1$ and $R^2$ represent the same one as represented by General Formula (1).

The basic compound is not particularly limited and may be suitably selected in accordance with the intended use. Examples of the basic compound include potassium carbonate, sodium carbonate, potassium hydroxide, sodium hydroxide, sodium hydride, sodium methylate, and potassium-t-butoxide.

The reaction solvent is not particularly limited and may be suitably selected in accordance with the intended use. Examples thereof include dioxane, tetrahydrofuran, toluene, xylene, dimethylsulfoxide, N,N-dimethylformamide, N-methylpyrrolidone, 1,3-dimethyl-2-imidazolidinone and acetonitrile.

Hereinafter, specific examples of the compound represented by any one of General Formulas (1) and (2) will be described. However, the compound is not limited to the following specific examples.

Compound No. 1

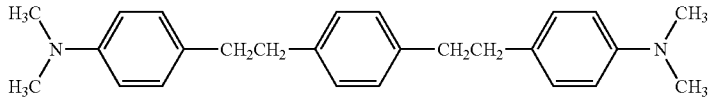

-continued
Compound No. 2
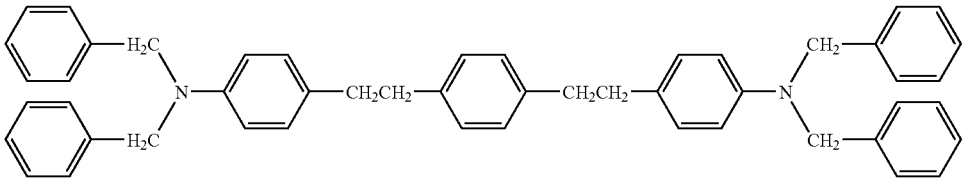
Compound No. 3
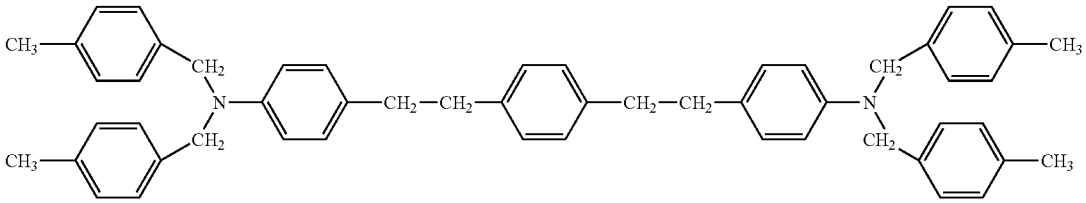
Compound No. 4
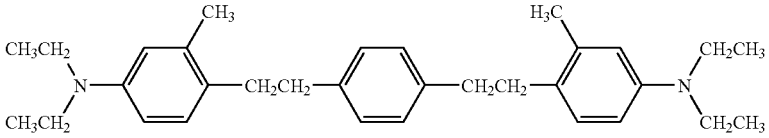
Compound No. 5
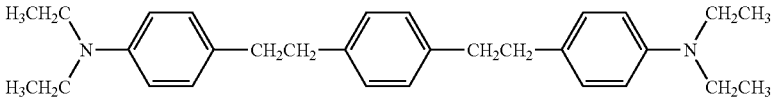
Compound No. 6
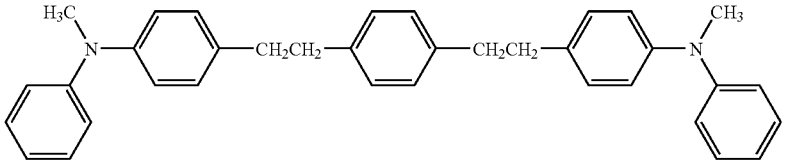
Compound No. 7
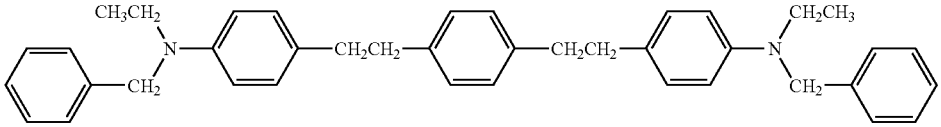
Compound No. 8
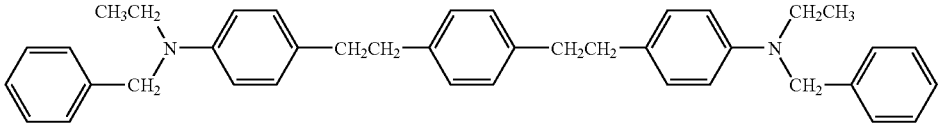
Compound No. 9
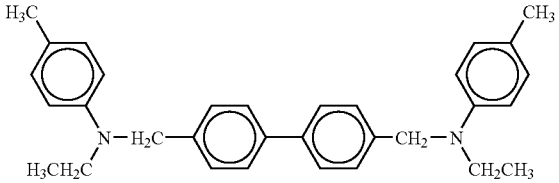
Compound No. 10
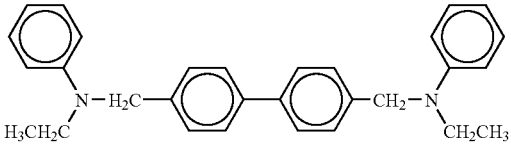
Compound No. 11
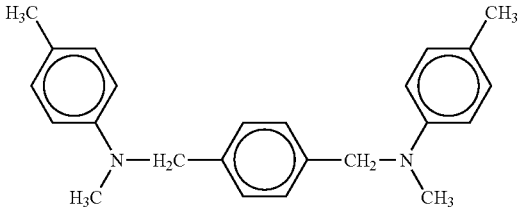
Compound No. 12
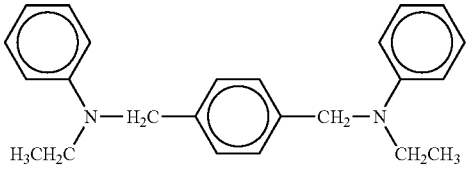

-continued

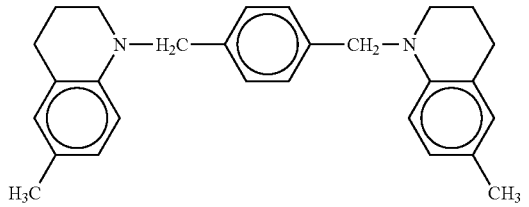

Compound No. 13

The amount of the compound represented by any one of General Formulas (1) and (2) in the outermost surface layer is preferably 1% by mass to 60% by mass, and more preferably 2% by mass to 50% by mass.

When storage stability for the coating solution for the outermost surface layer is required, in which the compound represented by any one of General Formulas (1) and (2) is used in combination with an organic compound having an acidic value of 10 mgKOH/g to 700 mgKOH/g, it is preferable to add a specific antioxidant to the coating solution in order to inhibit generation of salts by the cross-interaction thereof. The generation of salts may cause not only discoloration of the coating solution but also cause problems with increases in residual potential etc. in the electrophotographic photoconductor produced.

For antioxidants that can be used in the present invention, typical antioxidants to be described hereinafter can be used. Of these, hydroquinone compounds and hindered amine compounds are particularly preferable.

The antioxidant(s) to be used at this point in time in the present invention will be added for the purpose of protecting the compound represented by any one of General Formulas (1) and (2), the purpose being different from the purpose to be described below. For this reason, it is preferable that the antioxidant be added to the coating solution in a step before the compound represented by any one of General Formulas (1) and (2) is added to the coating solution. The additive amount of the antioxidant is preferably 0.1 parts by mass to 200 parts by mass to 100 parts by mass of the organic compound having an acidic value of 10 mgKOH/g to 700 mgKOH/g to ensure sufficient storage stability of the coating solution with a lapse of time.

A method of applying the thus obtained coating solution is not particularly limited and may be suitably selected in accordance with the intended use. For example, conventional coating methods such as immersion coating method, spray coating, bead coating, nozzle coating, spinner coating and ring coating can be used.

—Substrate—

The substrate is not particularly limited and may be suitably selected in accordance with the intended use as long as it exhibits conductive property of a volume resistance of $10^{10}$ Ω·cm or less. For example, the substrate may be formed by coating a film-like or cylindrical piece of plastic or paper with a metal such as aluminum, nickel, chrome, nichrome, copper, gold, silver or platinum or a metal oxide such as tin oxide or indium oxide by vapor deposition or sputtering; the substrate may be a plate of aluminum, aluminum alloy, nickel, stainless, etc., or a plate formed into a tube by extrusion or drawing and surface treating by cut, superfinishing and polishing can be used. Also, an endless nickel belt or an endless stainless belt disclosed in Japanese Patent Application Laid-Open (JP-A) No. 52-36016 can be used as a substrate. Also, the substrate may be a nickel foil having a thickness of 50 μm to 150 μm, or the a substrate may be prepared by subjecting a surface of a polyethylene terephthalate film having a thickness of 50 μm to 150 μm to a conductive treatment such as aluminum evaporation.

Besides, a substrate prepared by dispersing a fine conductive particle into a suitable binder resin and coating onto a substrate material can be used in the present invention.

Examples of the conductive powder include carbon black, acetylene black, a metal powder of aluminum, nickel, iron, nichrome, copper, zinc, silver, etc., or a metal oxide powder of conductive tin oxide and ITO. Examples of the binder resin used together with the conductive powder include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride, polyarylate resins, phenoxy resins, polycarbonate resins, cellulose acetate resins, ethylcellulose resins, polyvinyl butyral resins, polyvinyl formal resins, polyvinyl toluene resins, poly-N-vinylcarbazole, acrylic resins, silicone resins, epoxy resins, melamine resins, urethane resins, phenol resins and alkyd resins.

Such a conductive layer can be provided by dispersing the conductive powder and binder resin in a suitable solvent, for example tetrahydrofuran, dichloromethane, methyl ethyl ketone or toluene, and then applying them.

Further, the substrate which is prepared by forming a conductive layer on a suitable cylindrical base with an inner thermal contraction tube containing the conductive powder in a suitable material such as polyvinyl chloride, polypropylene, polyester, polystyrene, polyvinylidene chloride, polyethylene, chlorinated rubber or TEFLON (registered trademark) can also be favorably used as the conductive substrate in the present invention.

—Multi-Layered Photosensitive Layer—

The multi-layered photosensitive layer has at least a charge generating layer and a charge transporting layer formed in this order and further has a protective layer, an intermediate layer and other layers in accordance with necessity.

—Charge Generating Layer—

The charge generating layer contains at least a charge generating material and a binder resin in addition and further contains other components in accordance with necessity.

The charge generating material is not particularly limited and may be suitably selected in accordance with the intended use, and any one of an inorganic material and an organic material can be used. The inorganic material is not particularly limited and may be suitably selected in accordance with the intended use. Examples thereof include crystalline selenium, amorphous selenium, selenium-tellurium-halogen and selenium-arsenic compounds.

The organic material is not particularly limited and may be suitably selected from among conventional materials in accordance with the intended use. Examples thereof include C.I. Pigment Blue 25 (Color Index C.I. 21180), C.I. Pigment Red 41 (C.I. 21200), C.I Acid Red 52 (C.I. 45100), C.I. Basic Red 3 (C.I. 45210), azo pigments having a carbazole skeleton, azo pigments having distyryl benzene skeleton, azo pigments having a triphenylamine skeleton, azo pigments having a dibenzothiophene skeleton, azo pigments having an oxadiazole skeleton, azo pigments having a fluorenone skeleton, azo pigments having a bisstilbene skeleton, azo pigments having a distyryloxadiazole skeleton, azo pigments having a distyryl carbazole skeleton; phthalocyanine pigments such as C.I. Pigment Blue 16 (C.I. 74100); indigo pigments such as C.I Bat Brown (C.I. 73410) and C.I. Bat Dye (C.I. 730.50); perylene pigments such as ALGOL SCARLET B (manufactured by Bayer Co., Ltd.) and INDANTHRENE SCARLET R (manufactured by Bayer Co., Ltd.); and squaric dyes. Each of these organic pigments may be used alone or in combination with two or more.

The binder resin is not particularly limited and may be suitably selected in accordance with the intended use. Examples thereof include polyamide resins, polyurethane resins, epoxy resins, polyketone resins, polycarbonate resins, silicone resins, acryl resins, polyvinylbutyral resins, polyvinylformal resins, polyvinylketone resins, polystyrene resins, poly-N-vinylcarbazole resins, polyacrylamide resins, polyester resins, phenoxy resins, vinyl chloride-vinyl acetate copolymers, polyvinyl acetates, polyphenylene oxides, polyvinyl alcohols, polyvinyl pyrolidones and cellulose resins. Each of these may be used alone or in combination with two or more.

The additive amount of the binder resin is 0 parts by mass to 500 parts by mass and more preferably 10 parts by mass to 300 parts by mass to 100 parts by mass of the charge generating material. The binder resins may be added before or after the dispersion treatment.

Methods of forming the charge generating layer are broadly classified into vacuum thin-layer forming method and casting method using a solution dispersion liquid.

Examples of the former method, i.e., the vacuum thin-layer forming method include glow discharge decomposition, vacuum evaporation method, CVD method, sputtering method, reactive sputtering method, ion-plating method and accelerating ion-injection method. By the vacuum thin-layer forming method, the charge generating layer can be favorably formed with the use of the organic materials or the inorganic materials stated above.

Further, to form a charge generating layer by the latter method, i.e., the casting method, it can be formed by the use of a commonly used method such as immersion coating method, spray coating method and bead coating method with coating solution for the charge generating layer.

An organic solvent used for the charge generating layer coating solution is not particularly limited and may be suitably selected in accordance with the intended use. Examples thereof include acetone, methylethylketone, methyl isopropyl ketone, cyclohexanone, benzene, toluene, xylene, chloroform, dichloromethane, dichloroethane, dichloropropane, trichloroethane, trichloroethylene, tetrachloroethane, tetrahydrofuran, dioxsolane, dioxane, methanol, ethanol, isopropyl alcohol, butanol, ethyl acetate, butyl acetate, dimethylsulfoxide, methylcellosolve, ethyl cellosolve and propyl cellosolve. Each of these may be used alone or in combination with two or more.

Of these, tetrahydrofuran, methylethylketone, dichloromethane, methanol and ethanol, each of which has a boiling point of 40° C. to 80° C., are particularly preferable from the perspective of easiness of drying after being applied.

The charge generating layer coating solution is prepared by dispersing and dissolving the charge generating material and a binder resin in the above-noted organic solvent. For the method of dispersing an organic pigment in the organic solvent, for example, a dispersing method using a dispersion medium, for example, a ball mill, a bead mill, a sand mill and vibration mill and high-speed liquid collision dispersion methods are exemplified.

The thickness of the charge generating layer is preferably 0.01 μm to 5 μm, and more preferably 0.05 μm to 2 μm.

—Charge Transporting Layer—

The charge transporting layer is formed for the purposes of maintaining a charge and transporting a charge separately generated in the charge generating layer by exposure to combine the charge with the maintained charge. To achieve the purpose of maintaining a charge, it is required to have a high electrical resistance. Further, to achieve the purpose of obtaining a high-surface potential with the maintained charge, it is required to have a small dielectric constant and excellent charge transportability.

The charge transporting layer contains at least a charge transporting material. When the charge transporting layer is the outermost surface layer of the electrophotographic photoconductor, the charge transporting layer contains a compound represented by any one of General Formulas (1) and (2), a filler, an organic compound having an acidic value of 10 mgKOH/g to 700 mgKOH/g, a binder resin and further contains other components in accordance with necessity.

For the compound represented by any one of General Formulas (1) and (2), the filler and the organic compound having an acidic value of 10 mgKOH/g to 700 mgKOH/g, all the compounds described above for the outermost surface layer can be used.

For the charge transporting material, a low-molecular weight charge transporting material such as an electron hole transporting material and an electron transporting material can be used, and where necessary, a polymer charge transporting material can be further added to the charge transporting material.

Examples of the electron transporting material or electron accepting material include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on and 1,3,7-trinitrodibenzothiophene-5,5-dioxide. Each of these may be used alone or in combination with two or more.

Examples of the electron hole transporting material or electron donating material include oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenyl-hydrazones, α-phenyl-stilbene derivatives, thiazole derivatives, triazole derivatives, phenazine derivatives, acridine derivatives, benzofuran derivatives, benzimidazole derivatives and thiophene derivatives. Each of these may be used alone or in combination with two or more.

For the polymer charge transporting material, compounds having the following structures are exemplified.

(a) for polymers having a carbazole ring, for example, poly-N-vinyl carbazole; and the compounds described in Japanese Patent Application Laid-Open (JP-A) Nos. 50-82056, 54-9632, 54-11737, 4-175337, 4-183719 and 6-234841 are exemplified.

(b) for polymers having a hydrozone structure, for example, the compounds described in Japanese Patent Application Laid-Open (JP-A) Nos. 57-78402, 61-20953, 61-296358, 1-134456, 1-179164, 3-180851, 3-180852, 3-50555, 5-310904 and 6-234840 are exemplified.

(c) for polysilylene polymers, for example, the compounds described in Japanese Patent Application Laid-Open (JP-A) Nos. 63-285552, 1-88461, 4-264130, 4-264131, 4-264132, 4-264133 and 4-289867 are exemplified.

(d) polymers having a triarylamine structure, for example, N,N-bis(4-methylphenyl)-4-aminopolystyrene, the compounds described in Japanese Patent Application Laid-Open (JP-A) Nos. 1-134457, 2-282264, 2-304456, 4-133065, 4-133066, 5-40350 and 5-202135 are exemplified.

(e) for other polymers, for example, formaldehyde condensate polymers of nitropyrene, the compounds described in Japanese Patent Application Laid-Open (JP-A) Nos. 51-73888, 56-150749, 6-234836 and 6-234837 are exemplified.

Besides those stated above, examples of the polymer charge transporting material include polycarbonate resins having a triarylamine structure, polyurethane resins having a triarylamine structure, polyester resins having a triarylamine structure and polyether resins having a triarylamine structure. Specific examples of the polymer charge transporting material include the compounds described in 64-1728, 64-13061, 64-19049, 4-11627, 4-225014, 4-230767, 4-320420, 5-232727, 7-56374, 9-127713, 9-222740, 9-265197, 9-211877 and 9-304956 are exemplified.

For a polymer having an electron donating group, not only the above-noted polymers but also a copolymer with a known monomer, a block polymer, a graft polymer, a star polymer, further, a crosslinkable polymer having an electron donating group as disclosed, for example, in Japanese Patent Application Laid-Open (JP-A) No. 3-109406 can be used.

Examples of the binder resin include polystyrenes, styrene-acrylonitrile copolymers, styrene-butadiene copolymers, styrene-maleic anhydride copolymers, polycarbonate resins, polyester resins, methacrylic resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacrylamide resins and phenoxy resins. Each of these binder resins may be used alone or in combination with two or more.

The charge transporting layer can contain a copolymer of a crosslinkable binder with a crosslinkable charge transporting material.

The amount of the charge transporting material is preferably 20 parts by mass to 300 parts by mass, and more preferably 40 parts by mass to 150 parts by mass to 100 parts by mass of the binder resin.

The charge transporting layer can be formed by dissolving or dispersing the charge transporting material and the binder resin in an appropriate solvent, applying and drying it. To the charge transporting layer, additives such as a plasticizer, an antioxidant and a leveling agent can be added in an appropriate amount in accordance with necessity, besides the charge transporting material and the binder resin.

The thickness of the charge transporting layer is preferably 25 μm or less in terms of resolution and responsiveness, and the minimum value thereof varies depending on the used system, in particular, depending on charge potential and the like, however, it is preferably 5 μm or more.

—Single-Layer Photosensitive Layer—

The single-layered photosensitive layer contains a charge generating material, a charge transporting material, a binder resin and further contains other components in accordance with necessity.

For the charge generating material, the charge transporting material and the binder resin, the materials stated above can be used. Examples of the other components include plasticizers, fine particles and various additives. The additive amount of the charge generating material is preferably 5 parts by mass to 40 parts by mass to 100 parts by mass of the binder resin. The additive amount of the charge transporting material is preferably 0 parts by by mass to 190 parts by mass, and more preferably 50 parts by mass to 150 parts by mass to 100 parts by mass of the binder resin.

When the single-layered photosensitive layer is the outermost surface layer, the single-layered photosensitive layer contains a compound represented by any one of General Formulas (1) and (2) and a filler and an organic compound having an acidic value of 10 mgKOH/g to 700 mgKOH/g.

For the compound represented by any one of General Formulas (1) and (2), the filler and the organic compound having an acidic value of 10 mgKOH/g to 700 mgKOH/g, all the compounds described stated above for the outermost surface layer can be used.

In this case, the filler may be contained in the entire photosensitive layer. However, since the outermost surface layer containing a filler is effective in terms of improving abrasion resistance of the outermost surface layer, a concentration gradient of the filler may be provided or the photosensitive layer may be multi-layered with a concentration gradient so that each of layers has a different filler concentration.

The thickness of the single-layered photosensitive layer is not particularly limited and may be suitably adjusted in accordance with the intended use, and it is preferably 5 μm to 25 μm.

—Protective Layer—

In the electrophotographic photoconductor of the present invention, for the purpose of protecting the photosensitive layer and improving durability thereof, as the outermost surface layer, a protective layer containing a filler can be formed on the photosensitive layer. When the protective layer is formed as the outermost surface layer, the protective layer contains a compound represented by any one of General Formulas (1) and (2), a filler, a binder resin and an organic compound having an acidic value of 10 mgKOH/g to 700 mgKOH/g.

For the compound represented by any one of General Formulas (1) and (2), the filler and the organic compound having an acidic value of 10 mgKOH/g to 700 mgKOH/g, all the compounds described above for the outermost surface layer can be used.

Examples of the binder resin include AS resins, ABS resins, ACS resins, olefin-vinyl monomer copolymers, chlorinated polyether resins, allyl resins, phenol resins, polyacetal resins, polyamide resins, polyamideimide resins, polyacrylate resins, polyallyl sulfone resins, polybutylene resins, polybutylene terephthalate resins, polycarbonate resins, polyether sulfone resins, polyethylene resins, polyethylene terephthalate resins, polyimide resins, acrylic resins, polymethyl pentene resins, polypropylene resins, polyphenylene oxide resins, polysulfone resins, polyurethane resins, polyvinyl chloride resins, polyvinylidene chloride resins and epoxy resins.

Adding the low-molecular weight charge transporting material or the polymer charge transporting material, described above in the charge transporting layer, to the protective layer is effective and useful for reducing a residual potential and improving the quality of images.

The filler can be dispersed along with at least an organic solvent, the organic compound having an acidic value of 10 mgKOH/g to 700 mgKOH/g etc. using a conventional dispersing device such as a ball mill, an attritor, a sand mill or an ultrasonic wave. Of these dispersing devices, it is more preferable to use a ball mill from the perspective that it allows for increasing the contact efficiency between the filler and the organic compound having an acidic value of 10 mgKOH/g to 700 mgKOH/g and causes less amount of impurities mixed from the outside.

It is preferable to add the organic compound having an acidic value of 10 mgKOH/g to 700 mgKOH/g to a coating solution for the protective layer along with the filler and the organic solvent before the dispersion treatment of the filler, because it can prevent the filler from flocculating in the coating solution, can suppress the sedimentation property of the filler and can remarkably improve the dispersibility of the filler.

In the meanwhile, the binder resin and the charge transporting material can be added to the coating solution before the dispersion treatment, however, in this case, a slight reduction in dispersibility of the filler may be observed. For this reason, the binder resin and the charge transporting material are preferably added in a state of being dissolved in an organic solvent to the dispersed coating solution after the dispersion treatment of the filler.

A method of forming the protective layer is not particularly limited and may be suitably selected in accordance with the intended use. Examples thereof include immersion coating method, spray coating method, bead coating method, nozzle coating method, spinner coating method and ring coating method. Of these methods, spray coating method is particularly preferable from the perspective of uniformity of coated film. Further, the protective layer may be formed by applying the coating solution once so as to ensure a necessary thickness, however, it is more preferable to form a protective layer by applying the coating solution two times or more to make the protective layer multi-layered from the perspective of uniformity of the filler in the protective layer. With this, further effects of reducing residual potential, enhancing resolution and improving abrasion resistance can be obtained.

The thickness of the protective layer is preferably 0.1 μm to 10 μm. By adding the organic compound having an acidic value of 10 mgKOH/g to 700 mgKOH/g to the coating solution, residual potential of the electrophotographic photoconductor can be drastically reduced, which enables arbitrarily designing of the thickness of the protective layer. However, a significant increase in thickness of the protective layer tends to cause a slight degradation in image quality, and thus it is preferable to set the thickness to the required minimum thickness.

—Undercoat Layer—

Between the substrate and the photosensitive layer, an undercoat layer may be formed in accordance with necessity. The undercoat layer is formed for the purposes of improving adhesion property, preventing occurrence of moire, improving the coating property of upper layers and reducing the residual potential.

The undercoat layer contains at least a resin and a fine powder and further contains other components in accordance with necessity.

Examples of the resin include water-soluble resins such as polyvinyl alcohol resins, caseins and sodium polyacrylate; alcohol-soluble resins such as copolymer nylons and methoxy methylated nylons; and curable resins capable of forming a three-dimensional network structure such as polyurethane resins, melamine resins, alkyd-melamine resins and epoxy resins.

Examples of the fine powder include metal oxides, metal sulfides or metal nitrides of, for example, titanium oxides, silicas, aluminas, zirconium oxides, tin oxides and indium oxides.

For the undercoat layer, a coating solution containing a silane coupling agent, a titanium coupling agent and/or chrome coupling agent can also be used. Further, as the undercoat layer, an undercoat layer formed by anodizing $Al_2O_3$, and an undercoat layer formed with an organic material such as polyparaxylylene (parylene) or an inorganic material such as $SiO_2$, $SnO_2$, $TiO_2$, ITO and $CeO_2$ by a vacuum thin-layer forming method can also be used.

The thickness of the undercoat layer is not particularly limited and may be suitably adjusted in accordance with the intended use, and it is preferably 0.1 μm to 10 μm, and more preferably 1 μm to 5 μm.

In the electrophotographic photoconductor of the present invention, for the purpose of improving adhesion property and charge blocking property, an intermediate layer may be formed on the substrate in accordance with necessity. The intermediate layer primarily contains a resin, however, the resin is preferably a resin having a high-solvent resistance to organic solvents in consideration that a solvent is applied over the surface of the resin to form the photosensitive layer. For the resin, a similar resin to that used for the undercoat layer can be suitably selected for use.

Furthermore, in the electrophotographic photoconductor of the present invention, for the purpose of improving environmental resistance, in particular, for the purpose of preventing a reduction in photosensitivity and an increase in residual potential on the electrophotographic photoconductor, an antioxidant, a plasticizer, a lubricant, an ultraviolet absorbent, a low-molecular weight charge transporting material, a leveling agent and the like can be added to respective layers such as the charge generating layer, the charge transporting layer, the undercoat layer, the protective layer and the single-layered photosensitive layer.

Examples of the antioxidant include phenol compounds, paraphenylene diamines, organic sulfur compounds and organic phosphorous compounds.

Examples of the phenol compounds include 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-buthylidenebis-(3-methyl-6-t-butylphenol), 1,1,3-tris-(2-methyl-4-hydroxy-5-t-butylphenyl) butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester and tocopherols.

Examples of the paraphenylenediamines include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine.

Examples of the hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone and 2-(2-octadecenyl)-5-methylhydroquinone.

Examples of the organic sulfur compounds include dilauryl-3,3'-thiodipropyonate, distearyl-3,3'-thiodipropyonate, ditetradecyl-3,3'-thiodipropyonate.

Examples of the organic phosphorous compounds include triphenylphosphine, tri(nonylphenyl)phosphine, tri(dinonylphenyl)phosphine, tricresyl phosphine and tri(2,4-dibutylphenoxy)phosphine.

These compounds are known as antioxidants for fats and fatty oils, the commercial products thereof are easily available.

The additive amount of the antioxidant is preferably 0.01% by mass to 10% by mass to the total mass of the layer.

Plasticizers that can be added to the respective layers are not particularly limited and may be suitably selected in accordance with the intended use. Examples thereof include phosphoric acid ester plasticizers, phthalic acid ester plasticizers, aromatic carboxylic acid ester plasticizers, aliphatic dibasic acid ester plasticizers, fatty acid ester derivatives, oxyester plasticizers, epoxy plasticizers, divalent alcohol ester plasticizers, chlorine-containing plasticizers, polyester plasticizers, sulfonic acid derivatives, citric acid derivatives and other plasticizers.

Examples of the phosphoric acid ester plasticizers include triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate and triphenyl phosphate.

Examples of the phthalic acid ester plasticizers include dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyl lauryl phthalate, methyl oleyl phthalate, octyldecyl phthalate, dibutyl fumarate and dioctyl fumarate.

Examples of the aromatic carboxylic acid ester plasticizers include trioctyl trimellitate, tri-n-octyl trimellitate, and octyloxy benzoate.

Examples of the aliphatic dibasic acid ester plasticizers include dibutyl adipate, di-n-hexyl adipate, di-2-ethylhexyl adipate, di-n-octyl adipate, n-octyl-n-decyl adipate, diisodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate and di-n-octyl tetrahydrophthalate.

Examples of the fatty acid ester derivatives include butyl oleate, glycerine monooleate ester, methylacetyl ricinoleate, pentaerythritol ester, dipentaaerythritol hexaester, triacetine and tributyrin.

Examples of the oxy acid ester plasticizers include methylacetyl ricinoleate, butylacetyl ricinoleate, butylphthalyl butyl glycolate and tributyl acetyl citrate.

Examples of the epoxy plasticizers include epoxidized soybean oil, epoxidized linseed oil, epoxy butyl stearate, epoxy decyl stearate, epoxy octyl stearate, epoxy benzyl stearate, epoxy dioctyl hexahydrophthalate and epoxy didecyl hexahydrophthalate.

Examples of the divalent alcohol ester plasticizers include diethylene glycol dibenzoate and triethylene glycol di-2-ethyl butyrate.

Examples of the chlorine-containing plasticizers include chlorinated paraffin, chlorinated diphenyl, chlorinated methyl fatty acid and methoxy chlorinated methyl fatty acid.

Examples of the polyester plasticizers include polypropylene adipate, polypropylene sebacate, polyester and acetylated polyester.

Examples of the sulfonic acid derivatives include p-toluene sulfone amide, o-toluene sulfone amide, p-toluene sulfone ethyl amide, o-toluene sulfone ethyl amide, toluene sulfone-N-ethyl amide and p-toluene sulfone-N-cyclohexyl amide.

Examples of the citric acid derivatives include triethyl citrate, triethyl acetyl citrate, tributyl citrate, tributyl acetyl citrate, tri-2-ethylhexyl acetyl citrate and n-octyldecyl acetyl citrate.

Examples of the other plasticizers include terphenyl, partly hydrogenerated terphenyl, camphor, 2-nitrodiphenyl, dinonyl naphthalene and methyl abietate.

Lubricants that can be added to the respective layers are not particularly limited and may be suitably selected in accordance with the intended use. Examples thereof include hydrocarbon compounds, fatty acid compounds, fatty acid amide compounds, ester compounds, alcohol compounds, metal soaps, natural waxes and other lubricants.

Examples of the hydrocarbon compounds include liquid paraffins, paraffin waxes, micro waxes and low polymer polyethylenes.

Examples of the fatty acid compounds include lauric acids, myristic acids, palmitic acids, stearic acids, arachic acids and behenic acids.

Examples of the fatty acid amide compounds include stearylamide, palmityl amide, oleinamide, methylenebis stearoamide and ethylenebis stearoamide.

Examples of the ester compounds include lower alcohol esters of fatty acids, polyvalent alcohol esters of fatty acids and polyglycol esters of fatty acids.

Examples of the alcohol compounds include cetyl alcohols, stearyl alcohols, ethylene glycols, polyethylene glycols and polyglycerols.

Examples of the metal soaps include lead stearates, cadmium stearates, barium stearates, calcium stearates, zinc stearates and magnesium stearates.

Examples of the natural waxes include carnauba waxes, candelilia waxes, bee waxes, whale waxes, privet waxes and montan waxes.

Examples of the other lubricants include silicone compounds and fluorine compounds.

Ultraviolet absorbents that can be added to the respective layers are not particularly limited and may be suitably selected in accordance with the intended use. Examples thereof include benzophenone ultraviolet absorbents, salicylate ultraviolet absorbents, salicylate ultraviolet absorbents, benzotriazole ultraviolet absorbents, cyanoacrylate ultraviolet absorbents, quencher (metal complex salt) ultraviolet absorbers and HALS (hindered amine).

Examples of the benzophenone ultraviolet absorbents include 2-hydroxybenzophenone, 2,4-dihydroxybenzophenone, 2,2',4-trihydroxybenzophenone, 2,2',4,4'-tetrahydroxybenzophenone and 2,2'-dihydroxy 4-methoxybenzophenone.

Examples of the salicylate ultraviolet absorbents include phenyl salicylate and 2,4-di-t-butylphenyl-3,5-di-t-butyl-4-hydroxybenzoate.

Examples of the benzotriazole ultraviolet absorbents include (2'-hydroxyphenyl)benzotriazole, (2'-hydroxy 5'-methylphenyl)benzotriazole and (2'-hydroxy 3'-tertiary butyl 5'-methylphenyl)5-chlorobenzotriazole.

Examples of the cyanoacrylate ultraviolet absorbents include ethyl-2-cyano-3,3-diphenyl acrylate and methyl 2-carbomethoxy 3 (paramethoxy)acrylate.

Examples of the quencher (metal complex salt) ultraviolet absorbents include nickel (2,2'thiobis (4-t-octyl)phenolate) normal butylamine, nickel dibutyldithio carbamate, nickel dibutyldithio carbamate and cobalt dicyclohexyl dithio phosphate.

Examples of the HALS (hindered amine) include bis(2,2,6,6-tetramethyl-4-piperidyl)sebacate, bis(1,2,2,6,6-pentamethyl-4-piperidyl)sebacate, 1-{2-[3-(3,5-di-t-butyl-4-hydroxyphenyl)propionyloxy]ethyl}-4-[3-(3,5-di-t-butyl-4-hydroxyphenyl)propionyloxy]-2,2,6,6-tetramethyl pyridine, 8-benzyl-7,7,9,9-tetramethyl-3-octyl-1,3,8-triazaspiro[4,5] undecan-2,4-dion and 4-benzoyloxy-2,2,6,6-tetramethyl piperidine.

<Charging Step and Charging Unit>

The charging step is a step in which the surface of an electrophotographic photoconductor is charged by using a charging unit.

The charging unit is not particularly limited and may be suitably selected in accordance with the intended use as long as it can apply a voltage to the surface of the electrophotographic photoconductor to uniformly charge the surface, however, a non-contact type charging unit that can charge the surface in non-contact manner with the surface of the electrophotographic photoconductor is used in the present invention.

Examples of the non-contact type charging unit include non-contact chargers utilizing a corona discharge, a needle electrode device, a solid discharge device; a conductive or semi-conductive charge roller placed in a narrow space with an electrophotographic photoconductor. Of these, non-contact chargers utilizing a corona discharge are particularly preferable.

The corona discharge is a charging method in which a positive or negative ion generated by a corona discharge in the air is given to the surface of an electrophotographic photoconductor to charge the electrophotographic photoconductor surface in a non-contact manner. The corona discharge chargers are classified into corotoron chargers having a characteristic that a constant charge amount is given to an electrophotographic photoconductor, and scorotoron charges having a characteristic that a constant electric potential is given to an electrophotographic photoconductor.

The corotron charger is composed of casing electrodes occupying the half-space thereof around a discharge wire which is positioned roughly in the center of the casing electrodes.

The scorotron charger is a charger of which grid electrodes are added to the corotron charger, and the grid electrodes are positioned 1.0 mm to 2.0 mm away from the surface of an electrophotographic photoconductor.

The following methods are examples of maintaining ozone concentration in a certain range according to the present invention at the surface of the electrophotographic photoconductor in a discharge region of the charging unit.

(a) Air is taken from the outside of the image forming apparatus. The air is then carried to the electrophotographic photoconductor, which is placed to face the charging unit, from the back of the charging unit through the inside of the charging unit. Finally, the air is exhausted to the outside of the image forming apparatus from a gap between the charging unit and the electrophotographic photoconductor.

(b) The air adjusting device takes air from the outside of the image forming apparatus and carries the air to the back of the charging unit from the gap between the charging unit and the electrophotographic photoconductor, which are placed to face each other, through the inside of the charging unit. Finally, the air adjusting device exhausts the air to the outside of the image forming apparatus from the back of the charging unit.

More specific examples are as follows:

(c) Air is taken from the outside of the image forming apparatus by using at least one fan. The air is carried to in order of a first duct, the inside of the charging unit and a second duct. Finally, the air is exhausted using at least one fan to the outside of the image forming apparatus. In this method, quantity of airflow from the fan is controlled, thereby maintaining the ozone concentration at an average of 30 ppm or less and unevenness of the ozone concentration at 15 ppm or less at the surface of the electrophotographic photoconductor in the discharge region of the charging unit.

(d) Air is taken from the outside of the image forming apparatus by using at least two fans. The air taken is carried to in order of two corresponding ducts, the inside of the charging unit and other two corresponding ducts. Finally, the air is exhausted using at least two fans to the outside of the image forming apparatus. In this method, quantity of the airflow from these four fans is controlled, thereby maintaining the ozone concentration at an average of 30 ppm or less and the unevenness of the ozone concentration at 15 ppm or less at the surface of the electrophotographic photoconductor in the discharge region of the charging unit.

By the methods described above, the ozone concentration is maintained at an average of 30 ppm or less and the unevenness of the ozone concentration at 15 ppm or less at the surface of the electrophotographic photoconductor in the discharge region of the charging unit, the image forming region of the charging unit. The discharge region is an image forming region of the charging unit. By adding a compound represented by any one of General Formulas (1) and (2) to the outermost surface layer of the electrophotographic photoconductor, it is possible to prevent image deletion, image blur and unevenness of halftone image density.

<Exposing Step and Exposing Unit>

The exposure can be performed by imagewisely exposing the surface of the electrophotographic photoconductor using the exposing unit.

Optical systems used in the exposure are broadly classified into analog optical systems and digital optical systems. The analog optical system is an optical system of which an original document is directly projected onto an electrophotographic photoconductor through the use of an optical system. The digital optical system is an optical system in which an image is formed by giving image information as electric signals and converting the electric signals into light signals and exposing an electrophotographic photoconductor using the light signals.

The exposing unit is not particularly limited and may be suitably selected in accordance with the intended use as long as it can imagewisely expose the electrophotographic photoconductor surface that has been charged by the charging unit. Examples thereof include various exposers such as reproducing optical systems, rod lens array systems, laser optical systems, liquid crystal shutter optical systems and LED optical systems.

In the present invention, the back light method may be employed in which exposure is performed imagewisely from the back side of the photoconductor.

—Developing Step and Developing Unit—

The developing step is a step in which the latent electrostatic image is developed using a toner or a developer to form a visible image.

The visible image can be formed, for example, by developing the latent electrostatic image using the toner or the developer, by means of the developing unit.

The developing unit is not particularly limited and may be suitably selected from among those known in the art as long as it can develop an image using the toner or the developer. For example, a developing unit having at least a developing device which houses the toner or the developer and supplies the toner or the developer to the latent electrostatic image in a contact or non-contact state is preferably exemplified.

The developing device may employ a dry-developing process or a wet-developing process. It may be a monochrome color image developing device or a multi-color image developing device. Preferred examples thereof include a developing device having a stirrer by which the toner or the developer is frictionally stirred to be charged, and a rotatable magnet roller.

In the image developing device, for example, the toner and a carrier are mixed and stirred, the toner is charged by frictional force at that time to be held in a state where the toner is standing on the surface of the rotating magnet roller to thereby form a magnetic brush. Since the magnet roller is located near the electrophotographic photoconductor (photoconductor), a part of the toner constituting the magnetic brush formed on the surface of the magnet roller moves to the surface of the electrophotographic photoconductor by an electric attraction force. As the result, the latent electrostatic image is developed using the toner to form a visible toner image on the surface of the electrophotographic photoconductor.

The developer to be housed in the developing device is a developer which contains the toner, however, the developer may be a one-component developer or a two-component developer.

—Transferring Step and Transferring Unit—

The transferring step is a step in which the visible image is transferred onto a recording medium, and it is preferably an aspect in which an intermediate transfer member is used, the visible image is primarily transferred to the intermediate transfer member and then the visible image is secondarily transferred onto the recording medium. Another aspect of the transferring step is more preferable, which includes, using two or more color toners, still more preferably, using a full-color toner, a primary transferring step in which the visible image is transferred to an intermediate transfer member to form a composite transfer image thereon, and a secondary transferring step in which the composite transfer image is transferred onto a recording medium.

The visible image can be transferred, for example, by charging the electrophotographic photoconductor using a transfer-charger. The transferring unit preferably includes a primary transferring unit and a secondary transferring unit. The primary transferring unit is configured to transfer the visible image to an intermediate transfer member to form a composite transfer image. The secondary transferring unit is configured to transfer the composite transfer image onto a recording medium.

The intermediate transfer member is not particularly limited, may be suitably selected from among those known in the art in accordance with the intended use, and preferred examples thereof include transfer belts.

The transferring unit (the primary transferring unit and the secondary transferring unit) preferably includes at least an image-transferer configured to exfoliate and charge the visible image formed on the electrophotographic photoconductor to transfer the visible image onto the recording medium. The transferring unit may be one transferring unit or two or more transferring units.

Examples of the image transferer include corona transferers utilizing a corona discharge electrode, transfer belts, transfer rollers, pressure transfer rollers and adhesion image transferers.

The recording medium is typified by regular paper, however, is not particularly limited and may be suitably selected from conventional recording media, provided that developed but unfixed images can be transferred thereonto. PET based recording media for OHP can also be used.

—Fixing Step and Fixing Unit—

The fixing step is a step in which the visible image transferred onto the recording medium is fixed using a fixing device. Fixing of the image can be performed every time each color toner is transferred onto the recording medium or at a time so that each of individual color toners is superimposed at the same time.

The fixing unit is not particularly limited and may be suitably selected in accordance with the intended use, however, a fixing unit having a fixing member and a heat source for heating the fixing member is used in the present invention.

Examples of the fixing member include a combination of an endless belt and a roller and a combination of a roller and a roller. It is preferable to use a combination of an endless belt which is small in heat capacity, and a roller in terms of its capability of shortening the warm-up time length, realization of saving of energy and enlarging a fixable width.

<Charge-Eliminating Step and Charge-Eliminating Unit>

The charge-eliminating step is a step in which a charge-eliminating bias is applied to the electrophotographic photoconductor to eliminate a charge. The charge elimination can be favorably carried out by means of a charge-eliminating unit.

The charge-eliminating unit is not particularly limited as long as it can apply a charge-eliminating bias to the electrophotographic photoconductor, and may be suitably selected from among conventional charge-eliminating devices. For example, a charge-eliminating lamp or the like can be preferably used.

<Cleaning Step and Cleaning Unit>

The cleaning step is a step in which a residual toner remaining on the electrophotographic photoconductor is removed. The cleaning of the electrophotographic photoconductor can be preferably performed by a cleaning unit. It is also possible to employ a method in which the charge of a residual toner is almost uniformed with a rubbing member and then collected with a developing roller.

The cleaning unit is not particularly limited as long as a residual electrophotographic toner remaining on the electrophotographic photoconductor can be removed with the cleaning unit. The cleaner may be suitably selected from among those known in the art. Preferred examples thereof include magnetic brush cleaners, electrostatic brush cleaners, magnetic roller cleaners, blade cleaners, brush cleaners and web cleaners.

<Lubricant Applying Step and Lubricant Applying Unit>

The lubricant applying step is a step in which a lubricant is applied over the surface of the electrophotographic photoconductor by means of a lubricant providing unit. The lubricant applying unit is preferably located downstream the cleaning unit in the rotational direction of the electrophotographic photoconductor. The lubricant applying unit has a lubricant supplying unit configured to supply the lubricant onto the electrophotographic photoconductor and a lubricant applying unit configured to apply the supplied lubricant over the surface of the electrophotographic photoconductor.

The lubricant applying unit is preferably a cleaning blade and a coating blade which is separately provided.

Material of the cleaning and coating blades is not particularly limited and may be suitably selected from among conventional materials used for cleaning blades in accordance with the intended use. Examples thereof include urethane rubbers, hydrin rubbers, silicone rubbers and fluorine rubbers. Each of these may be used alone or in combination with two or more. In each of these blades, the contact portion with the electrophotographic photoconductor may be coated with or subjected to an immersion treatment with a material having a low friction coefficient. To control the hardness of an elastic blade, a filler such as an organic filler and an inorganic filler may be dispersed in the material having a low friction coefficient.

The cleaning and coating blades are fixed on a blade support by a given method such as bonding or fusion bonding so that the edge of the coating blade can be pressed against the surface of the electrophotographic photoconductor to make contact therewith. The thickness of the coating blade cannot be unequivocally defined because it varies depending on the pressing force applied, however, it is preferably 0.5 mm to 5 mm and more preferably 1 mm to 3 mm.

Also, the length of the blade with which the blade can be projected from the blade support and can have a flexure, a so-called free length, cannot be unequivocally defined because it varies depending on the pressing force applied, as with the case for the thickness thereof. However, the free length is preferably 1 mm to 15 mm and more preferably 2 mm to 10 mm.

As another configuration of the blade, on the surface of an elastic metal blade such as a leaf spring, a coating layer composed of a resin, a rubber or an elastomer is formed by coating method, leaf dipping method or the like via a coupling agent or a primer component etc. in accordance with necessity, and the elastic metal blade surface coated with the layer is thermally hardened where necessary, if further necessary, the hardened surface may be subjected to a surface polishing treatment or the like.

The coating layer contains at least a binder resin and a filler and further contains other components.

The binder resin is not particularly limited and may be suitably selected in accordance with the intended use. Examples thereof include fluorine resins such as PFA, PTFE, FEP and PVDF; and silicone-based elastomers such as fluorine-based rubbers and methylphenyl silicone elastomers.

The thickness of the elastic metal blade is preferably 0.05 mm to 3 mm and more preferably 0.1 mm to 1 mm. To prevent distortion of the elastic metal blade, it may be subjected to a bending work etc. in the direction such that the blade attached to the blade support is approximately parallel with a spindle used.

For the pressing force applied by the coating blade to the electrophotographic photoconductor, a pressing force with which the lubricant can be spread and formed into a layer is sufficient, and the spring pressure is preferably 1.0N to 10N and more preferably 2.0N to 8.0N.

The lubricant supplying unit is a brush roller which rotates in a state where it makes contact with the electrophotographic photoconductor, and it is preferable that a lubricant is rubbed off and scraped off with the brush roller to supply the lubricant onto the electrophotographic photoconductor.

In this case, to suppress the mechanical stress applied to the photoconductor surface, the brush fiber preferably has flexibility. Material of the flexible brush fiber is not particularly limited and may be suitably selected in accordance with the intended use. Examples thereof include polyolefin resins (e.g., polyethylene and polypropylene); polyvinyl resins or polyvinylidene resins (e.g., polystyrene, acrylic resin, polyacrylonitrile, polyvinyl acetate, polyvinyl alcohol, polyvinyl butyral, polyvinyl chloride, polyvinyl carbazole, polyvinyl ether and polyvinyl ketone); vinyl chloride-vinyl acetate copolymers; styrene-acrylic acid copolymers; styrene-butadiene resins; fluorine resins (e.g., polytetrafluoroethylene, polyvinyl fluoride, polyvinylidene fluoride and polyclorotrifluoromethylene); polyesters; nylons; acryls; rayon; polyurethane; polycarbonates; phenol resins; amino resins (e.g., urea-formaldehyde resin, melamine resin, benzoguanamine resin, urea resin and polyamide resin).

To control the degree of flexure, for example, a diene-based rubber, a styrene-butadiene rubber (SBR), an ethylene propylene rubber, an isoprene rubber, a nitrile rubber, a urethane rubber, a silicone rubber, a hydrin rubber, a norbornene rubber or the like may be compounded.

For the support of the lubricant supplying unit, a fixed type support and a rotatable roller-shaped support are exemplified. Examples of the roller-shaped supplying member include roller brushes in each of which a tape which is prepared by forming a brush fiber into a pile fabric is spirally twisted around a metal cored bar. The brush fiber preferably has a brush fiber diameter of around 10 μm to 500 μm, a brush fiber length of 1 mm to 15 mm, a brush density of 10,000 per square inch to 300,000 per square inch ($1.5\times10^7$/1 m2 to $4.5\times10^8$/1 m2).

It is preferable to use a lubricant supplying unit having a high brush density from the perspective of uniformly and stably supplying the lubricant to the electrophotographic photoconductor, and it is also preferable that one brush fiber be formed in a bundle of several fine fibers to several hundred fine fibers. For example, 50 fine fibers of 6.7 decitex (6 denier), as in 333 decitex=6.7 decitex×50 filaments (300 denier=6 denier×50 filaments), are bundled into one fiber to be transplanted.

Further, on the surface of the brush, a coating layer may be formed in accordance with necessity for the purpose of stabilizing the surface shape of the brush and ensuring environmental stability. For components constituting the coating layer, it is preferable to use a component that can be deformed along the flexure of the brush fibers. The components used for the coating layer are not particularly limited and may be suitably selected in accordance with the intended use, as long as it is a material capable of maintaining its flexibility. Examples of such a material include polyolefin resins such as polyethylene, polypropylene, chlorinated polyethylene, chlorosulfonated polyethylene; polyvinyl or polyvinylidene resins such as polystyrene, acryls (for example, polymethyl methacrylate), polyacrylonitrile, polyvinyl acetate, polyvinyl alcohol, polyvinyl butyral, polyvinyl chloride, polyvinyl carbazole, polyvinyl ether and polyvinyl ketone; vinyl chloride-vinyl acetate copolymers; silicone resins constituted by an organosiloxane bond or modified products thereof (for example, modified products constituted by alkyd resin, polyester resin, epoxy resin, polyurethane resin, or the like); fluorine resins such as perfluoroalkyl ether, polyfluorovinyl, polyfluorovinylidene and polychlorotrifloroethylene; polyamide; polyester; polyurethane; polycarbonate; amino resins such as urea-formaldehyde; epoxy resins, or complex resins thereof.

For the lubricant, metal soap is preferably used. Examples of the metal soap include zinc stearate, barium stearate, lead stearate, iron stearate, nickel stearate, cobalt stearate, copper stearate, strontium stearate, calcium stearate, cadmium stearate, magnesium stearate, zinc oleate, manganese oleate, iron oleate, cobalt oleate, lead oleate, magnesium oleate, copper oleate, palmitic acid, zinc palmitate cobalt, copper palintate, magnesium palintate, aluminum palmitate, calcium palmitate, lead caprylate, lead caproate, zinc linolenate, cobalt linolenate, calcium linolenate, cadmium lycolinolenate, candellila waxes, carnauba waxes rice waxed, sumac waxes, jojoba oils, bee waxes and lanolin. Each of these may be used alone or in combination with two or more. Of these, zinc stearate, aluminum stearate and calcium stearate are particularly preferable.

For the method of forming the lubricant into a certain shape, for example, into a rectangular column or a cylindrical column, conventional methods of forming a solid material can be used. Examples thereof include melt-forming method, powder-forming method, heat press forming method, cold isostatical press (CIP) method and hot isostatical press (HIP) method.

The recycling step is a step in which the residual toner removed in the cleaning step is recycled to the developing unit. The recycling is favorably carried out by means of a recycling unit. The recycling unit is not particularly limited. Examples thereof include conventional conveying units.

The controlling step is a step in which the respective steps are controlled, and the control of the respective steps can be favorably carried out.

The controlling unit is not particularly limited as long as it can control operations of the respective units, and may be suitably selected in accordance with the intended use. Examples thereof include equipment such as sequencers and computers.

(Image Forming Apparatus)

Figure 6A:
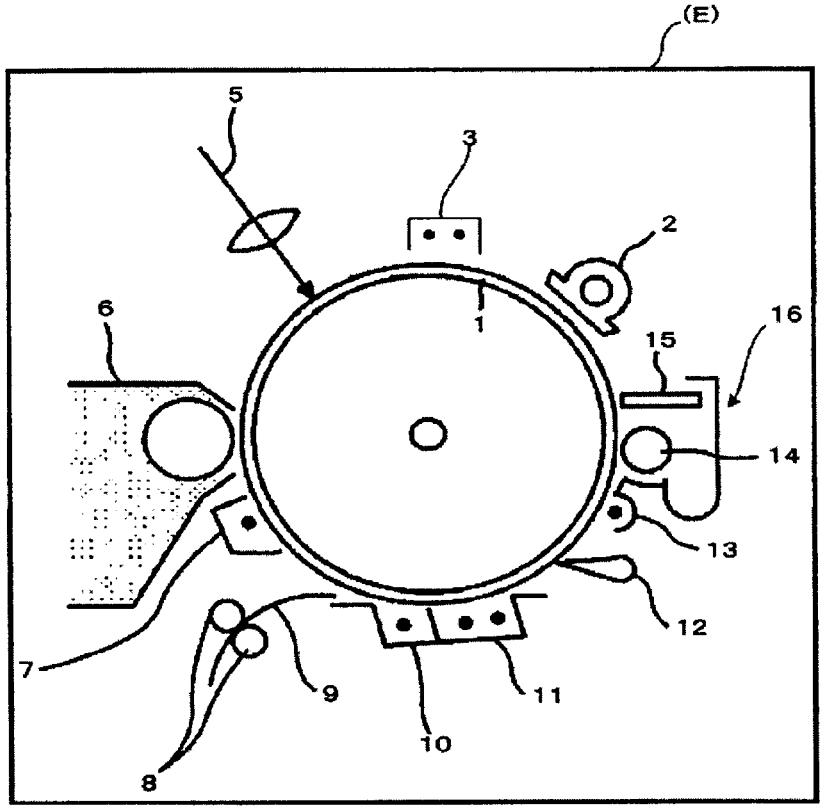
FIG. 6A is a schematic view showing one example the configuration of an image forming apparatus of the present invention.
Figure 6B:
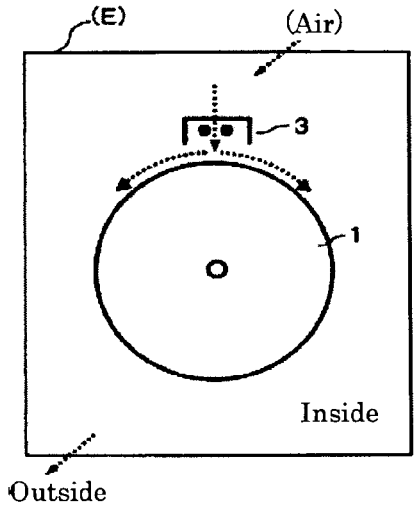
FIGS. 6B and 6C are schematic views showing airflow adjusted by an airflow adjusting device of the present invention.
Figure 6C:
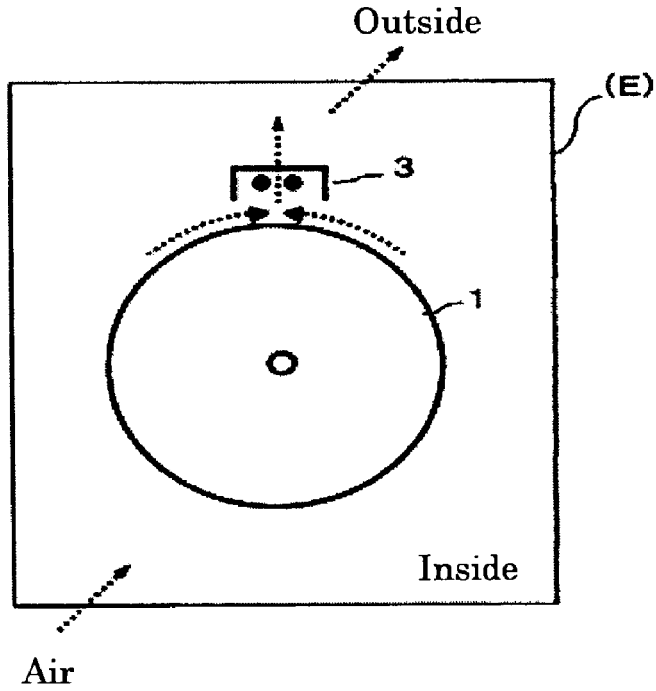

FIG. 6A is a schematic view showing one example of the configuration of the image forming apparatus of the present invention. FIGS. 6B and 6C are schematic view showing airflow controlled by the airflow controlling system. As shown in FIGS. 6B and 6C, the airflow adjusting device (not shown in the drawings) carries air taken from the outside of the image forming apparatus to the vicinity of a charging unit 3 or an electrophotographic photoconductor 1 placed to face the charging unit 3. The device exhausts the air to the outside of the apparatus. Thus, the ozone concentration is maintained at an average of 30 ppm or less on the surface of the electrophotographic photoconductor 1 in the discharge region (in the image forming region) of the charging unit 3. The unevenness of the ozone concentration is also maintained at 15 ppm or less. To maintain the ozone concentration and the unevenness thereof in a predetermined range, the aforementioned methods (a) to (d) can be used although the methods are not limited to these methods. It is possible to prevent image deletion, image blur and unevenness of a halftone image density by providing an airflow adjusting device in the scope of the present invention and adding a compound represented by any one of General Formulas (1) and (2) to the outermost surface layer of the electrophotographic photoconductor.

In FIG. 6A, the electrophotographic photoconductor (photoconductor) 1 of the image forming apparatus E is provided with at least one photosensitive layer, and the outermost surface layer contains a filler and a compound represented by any one of General Formula (1) and (2). In FIG. 6A, the electrophotographic photoconductor 1 is formed in a drum-like shape, however, it may be formed in a sheet-like shape or an endless belt shape.

As a charging charger 3, a pre-transfer charger 7, a transfer charger 10, a separation charger 11 and a pre-cleaning charger 13, a corona discharge type charging unit using a non-contact type electrode, for example, a corotron charger, a scorotron charger or a solid state charger is used.

For the transferring unit, as shown in FIG. 6A, generally, the chargers mentioned above can be used, however, it is effective to use a combination of the transfer charger 10 and the separation charger 11.

The following general illuminants may be used as a light source of exposing unit 5, a charge eliminating lamp 2 or the like: a fluorescent light, tungsten lamp, halogen lamp, mercury vapor lamp, sodium lamp, light emitting diode (LED), laser diode (LD) and electro luminescence (EL). For exposing a light having only a desired wavelength, it is possible to use various filters such as a sharp cut filter, band pass filter, near-infrared cutting filter, dichroic filter, interference filter and color temperature conversion filter.

Besides the steps as shown in FIG. 6A, the electrophotographic photoconductor may be irradiated with light by providing with steps such as a transferring step, a charge eliminating step, a cleaning step or a pre-exposure in each of which light irradiation is carried out in combination, using a light source.

Next, a toner image developed on the electrophotographic photoconductor by a developing unit 6 is transferred onto a recording medium 9, however, all the toner particles used for the developing are not transferred onto the recording medium 9, and some toner particles remain on the is electrophotographic photoconductor 1. Such a residual toner will be removed from the electrophotographic photoconductor 1 by a cleaning unit 16 that is composed of a fur brush 14 and a blade 15. Cleaning of the electrophotographic photoconductor 1 may be performed using only a cleaning brush. For the cleaning brush, a conventional one typified by a fur brush and a magnetic fur brush can be used.

When the electrophotographic photoconductor is positively (negatively) charged and exposed imagewisely, a positively (negatively) charged latent electrostatic image is formed on the surface of the electrophotographic photoconductor. When the positively charged (negatively charged) latent electrostatic image is developed with a negatively polar toner (positively polar toner) (fine particles detectable by an electroscope), a positive image can be obtained. When developed with a positively polar toner (negatively polar toner), a negative image can be obtained. For the developing unit, a conventional unit can be used.

The wavelength of the charge eliminating lamp 2 serving as a charge eliminating unit may be within a wavelength region with which the electrophotographic photoconductor can have photosensitivity, and it is preferably a longer wavelength within a practical photosensitive wavelength region for photoconductors.

As various conditions for the cleaning blade, the blade contact angle is preferably ranging from 10 degrees to 30 degrees, the contact pressure is preferably ranging from 0.3 g/mm to 4 g/mm, the rubber hardness of a rubber used for the blade is preferably ranging 60 degrees to 70 degrees, the repulsive elasticity is preferably ranging from 30% to 70%, the Young's modulus is preferably ranging from 30 kgf/cm2 to 60 kgf/cm$^2$, the thickness is preferably ranging from 1.5 mm to 3.0 mm, the free length is preferably ranging from 7 mm to 12 mm and the biting amount of the blade edge into the electrophotographic photoconductor. As a material satisfying these physical properties, a urethane rubber blade is particularly preferable.

Figure 7:
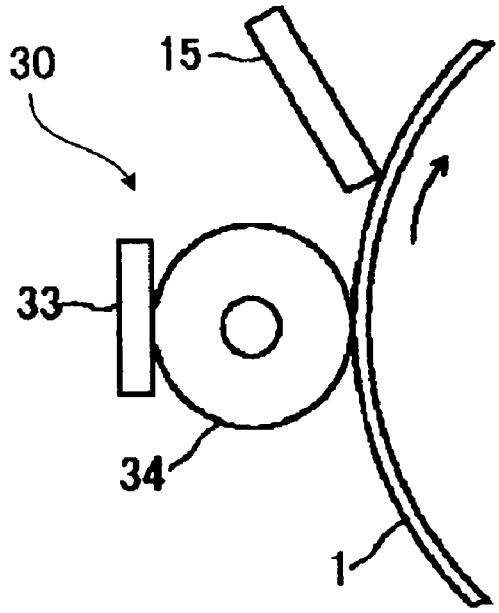
FIG. 7 is a schematic view showing one example of a conventional lubricant applying device.

Next, a conventional lubricant providing unit will be explained. To improve transfer efficiency and enhance cleaning ability to remove a residual transfer toner, in a cleaning unit 16 shown in FIG. 6A, a lubricant providing device 30 is provided, which is configured to provide a lubricant to an electrophotographic photoconductor 1, as shown in FIG. 7. In the lubricant providing device 30, a solid lubricant 33 is located near the photoconductor 1, and a brush roller 34 is located in a state of making contact with both the photoconductor 1 and the solid lubricant 33. At the time of supplying the lubricant 33, the lubricant providing device 30 is configured such that the brush roller 34 is rotated to scrape off the solid lubricant 33 with the brush roller 34 and the solid lubricant 33 adhered on the brush roller 34 is applied over the surface of the photoconductor 1.

In the lubricant providing device 30 as shown in FIG. 7, a lubricant is to be applied over the surface of a photoconductor with an unremoved toner remaining thereon. In the photoconductor surface intrinsically bearing an image thereon, on portions of the photoconductor surface corresponding to characters to be written, a large amount of a residual toner resides on the photoconductor surface even after a toner image has been transferred onto a recording medium, and on portions of the photoconductor surface corresponding to those other than the characters to be written, no residual toner actually resides. Then, starting from a part of the photoconductor surface where the adhesion amount of the residual toner is large, a large amount of a lubricant is scraped off by a cleaning blade in a cleaning position at which the brush roller is located along with the residual toner. Therefore, the amount of the lubricant applied over the photoconductor surface after the cleaning blade passed the cleaning position varies. Particularly when the same image is continuously output, photoconductor surface portions having a large amount of a residual toner constantly remain the same. Therefore, it results in such a variation in applied amount of lubricant.

Since a residual toner adheres on a coating member such as a brush roller, the brush roller is contaminated, and it is difficult to keeping on uniformly applying a lubricant for a long time. When a lubricant layer having a uniform thickness cannot be formed on the photoconductor surface, the static friction coefficient (μ) of the photoconductor surface will vary or will not be a sufficiently low value enough to transfer a toner, causing occurrence of transfer nonuniformity and abnormal images such as character dropout, vermiculate portions, image blur and tapered image lines. For this reason, there was a need to strongly press a solid lubricant to a brush roller to increase the supplied amount of the lubricant to the photoconductor.

Further, as a result of a study made by the present inventors, it was found that when an excessive amount of a lubricant is supplied to a photoconductor and a corona discharge type charging unit is used in combination with a lubricant providing unit, oxidizing gases adsorbed to a lubricant adhered on the photoconductor surface and are taken thereinto, and such a lubricant is hardly displaced by a new lubricant, and thus the lubricant adhered on the photoconductor surface has lower resistance, easily causing occurrence of image blur.

Further, when a cleaning blade 15 shown in FIG. 7 is provided in the upstream of the brush roller 34 in the rotational direction of the photoconductor 1 and a lubricant is applied to the photoconductor surface after cleaning the photoconductor surface, the applied lubricant will not be scraped off by the brush roller 34 or the cleaning blade 15, and therefore it is possible to prevent problems derived from the configuration of which the photoconductor 1 is applied with the lubricant and then cleaned. However, if the photoconductor surface applied with the lubricant entered to the transfer position as it is and then a toner image is transferred, it causes occurrence of abnormal images in spite of the fact that the static friction coefficient (μ) is within an appropriate range. This problem is caused because particles of a lubricant are not so fine to form a layer having a uniform thickness with just application of the lubricant, and it causes nonuniformity in thickness of the lubricant layer on the photoconductor surface, which affects the transfer property of the toner. When a lubricant layer having a uniform thickness cannot be formed on the photoconductor surface, the static friction coefficient (μ) of the photoconductor surface will vary or will not be a sufficiently low value enough to transfer a toner, causing occurrence of transfer nonuniformity and abnormal images such as character dropout, vermiculate portions, image blur and tapered image lines.

Next, the configuration of a cleaning device 48 according to the present invention shown in FIG. 8 will be explained. The cleaning device 48 is equipped with a cleaning blade 48*a* and a support member 48*c*. The cleaning blade 48*a* is formed of a rubber such as urethane rubber and silicone rubber, and is provided such that the edge thereof makes contact with the surface of a photoconductor 1 and is configured to remove a residual toner remaining on the photoconductor 1 after transfer of a toner image.

Figure 8:
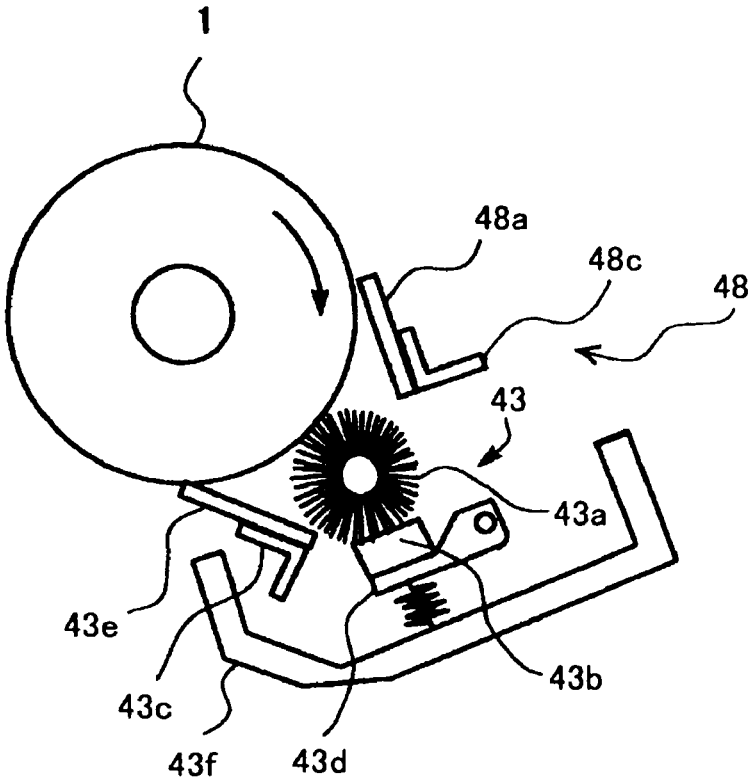
FIG. 8 is a schematic view showing one example of a lubricant applying device of the present invention.

The cleaning blade 48*a* is attached to and supported by the support member 48*c* made of metal, plastic, ceramics or the like, and is located at the angle to the surface of the photoconductor 1 as shown in FIG. 8.

A lubricant providing device 43 is placed downstream outside the cleaning device 48. The cleaning blade 48*a* is placed upstream in the moving direction of the photoconductor 1 and a lubricant applying blade 43*e* is placed downstream in the moving direction of the photoconductor 1. Over the surface of the photoconductor 1 in a clean state where a residual toner has been removed by the cleaning blade 48*a*, a lubricant is applied by the lubricant providing device 43. Then, a lubricant applying blade 43*e* rubs the surface of the photoconductor 1 to spread the applied lubricant, thereby forming a lubricant thin layer on the surface of the photoconductor 1.

The lubricant applying blade 43*e* is attached to and supported by a support member 43*c* made of metal, plastic, ceramics or the like, and is located at the angle to the surface of the photoconductor 1 as shown in FIG. 8.

In FIG. 8, the lubricant applying blade 43*e* makes contact with the photoconductor 1 in a trail direction, but it may make contact with the photoconductor 1 in the counter direction.

The lubricant providing device 43 shown in FIG. 8 will be further explained in detail. The lubricant providing device 43 is placed downstream outside the cleaning device 48 and is equipped with a solid lubricant 43*b* and a brush roller 43*a* as a brush member for applying the solid lubricant 43*b* to the photoconductor 1. The solid lubricant 43*b* is produced by dissolving lubricant additives primarily containing a zinc stearate and cooling and solidifying it and is formed in a bar shape. The solid lubricant 43*b* is held by a lubricant holding member 43*d* and is pressed against the brush roller 43*a* via a lubricant holding member 43*d* by means of a pressure spring attached to a housing 43*f* of the lubricant providing device 43. The brush roller 43*a* is provided so as to make contact with the photoconductor 1. By rotation of the brush roller 43*a*, the solid lubricant 43*b* is scraped off on the side of the brush roller

43*a*, and the adhered lubricant on the brush roller 43*a* then adheres to the surface of the photoconductor 1 from the contact portion between the brush roller 43*a* and the photoconductor 1. Then, the applied lubricant is uniformly spread by the lubricant applying blade 43*e*. The supplied amount of the lubricant to the photoconductor 1 can be controlled with a pressure applied to the solid lubricant 43*b* by a pressure spring pressed against the brush roller 43*a*.

The lubricant providing device as shown in FIG. 8 allows for uniformly applying a small supply amount of a lubricant in a thin layer. By employing the configuration, it is possible to increase the displacement efficiency of a lubricant adhered on the photoconductor. Oxidizing gases can be taken in and the lubricant that makes the photoconductor surface have lower resistance can be efficiently displaced by a new lubricant, which makes it possible not only to prevent occurrence of image blur on a photoconductor containing a filler on the outermost surface layer thereof but also to prevent a reduction in image density near a corona charger even when oxidizing gases and other materials accumulated on the corona charger fall on the photoconductor during stoppage in operation of the photoconductor, in particular, under high humidity conditions, because the lubricant will be displaced by a new lubricant.

For the solid lubricant 43*b*, a dry solid hydrophobic lubricant can be used. Preferred examples of the dry solid hydrophobic lubricant include zinc stearates, aluminum stearates and calcium stearates.

Figure 9:
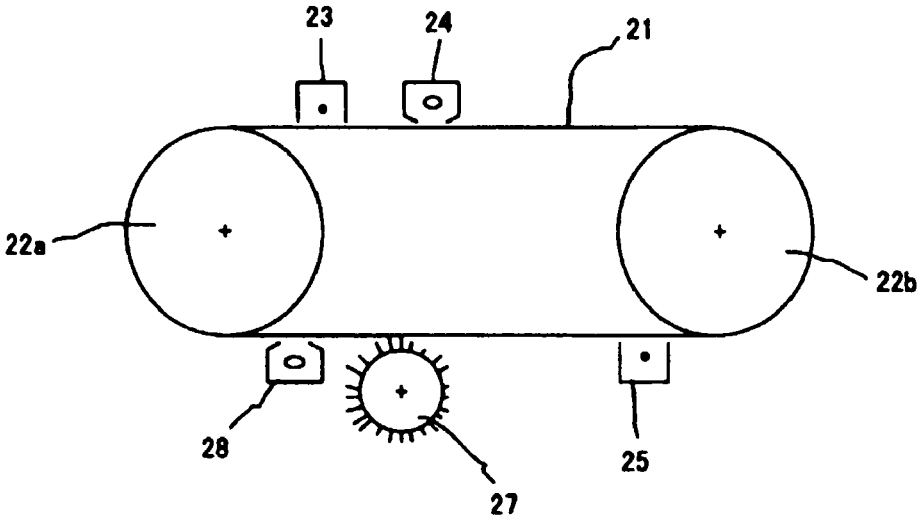
FIG. 9 is a schematic view showing another example of the configuration of the image forming apparatus using an electrophotographic process of the present invention.

Next, FIG. 9 is a schematic view showing one example of an electrophotographic process according to the present invention. A photoconductor 21 has at least a photosensitive layer and contains a compound represented by any one of General Formulas (1) and (2) and a filler. The photoconductor 21 is driven to rotate drive rollers 22*a* and 22*b*, and the surface of the photoconductor 21 is charged by a charger 23, image-wisely exposed by a light source 24, a latent electrostatic image is developed by a developing device (not shown) to form a visible image, the visible image is transferred using a transfer charger 25, the photoconductor surface is cleaned using a brush 27, and a charge on the photoconductor surface is eliminated by means of a light source 28. A series of the above-mentioned operation is repeatedly performed.

In the electrophotographic process shown in FIG. 9, as light irradiation steps, image exposure, pre-cleaning exposure, and exposure for charge elimination are illustrated in the figure, however, besides, pre-transfer exposure, pre-image exposure and other light irradiation steps known in the art may be provided to irradiate a photoconductor with light.

Figure 10:
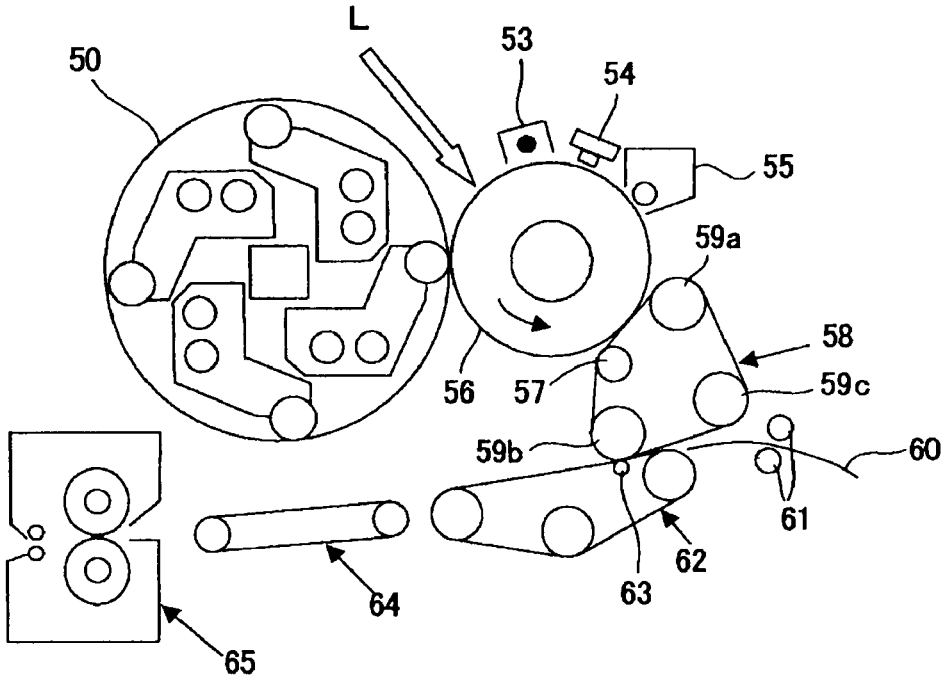
FIG. 10 is a schematic view showing still another example of the image forming apparatus of the present invention.

FIG. 10 is a schematic view exemplarily showing still another example of the image forming apparatus of the present invention. As in other examples, the ozone concentration and the unevenness thereof are maintained at a predetermined range at the surface of the electrophotographic photoconductor in the discharge region of the charging unit in this example. This is enabled by providing the airflow adjusting device according to the scope of the present invention and adding a compound represented by any one of General Formulas (1) and (2) to the outermost surface layer of the electrophotographic photoconductor. Therefore, it is possible to prevent image deletion, image blur, and unevenness of the halftone image density. In FIG. 10, the surface of a photoconductor drum 56 is uniformly charged by a charging charger 53 using corotron or scorotron while being driven to rotate in the counterclockwise direction in the figure and scanned with a laser light L emitted from a laser optical system (not shown) to thereby bear a latent electrostatic image.

Since the photoconductor surface is scanned based on monochrome image information in which full-color image is broken down into color information of yellow, magenta, cyan and black, monochrome latent electrostatic images of yellow, magenta, cyan and black are formed on the photoconductor drum 56. On the left hand side of the photoconductor drum 56 in the figure, a revolver developing unit 50 is placed. The revolver developing unit 50 has a rotating drum housing and has a yellow developing device, a magenta developing device, a cyan developing device and a black developing device in the drum housing and is configured to rotate so as to sequentially move the respective developing devices to a position in which to face the photoconductor drum 56. The yellow developing device, the magenta developing device, the cyan developing device and the black developing device are respectively configured to develop a each color latent electrostatic image by making a yellow toner, a magenta toner, a cyan toner and a black toner adhered thereon.

On the photoconductor drum 56, a yellow latent electrostatic image, a magenta latent electrostatic image, a cyan electrostatic image and a black latent electrostatic image are sequentially formed. These latent electrostatic images are sequentially developed by the respective developing devices placed in the revolver developing unit 50 to be formed as a yellow toner image, a magenta toner image, a cyan toner image and a black toner image.

In the lower stream of the photoconductor drum 56 than the developing position, an intermediate transferring is placed. The intermediate transferring is provided with a spanned roller 59*a*, an intermediate transfer bias roller 57 serving as a transferring and a secondary transfer backup roller 59*b* and is configured to move in an endless manner, an intermediate transfer belt 58 that is spanned by a belt drive roller 59*c* in the clockwise direction in the figure by a rotation drive force given from the belt drive roller 59*b*. The yellow toner image, the magenta toner image, the cyan toner image and the black toner image developed on the photoconductor drum 56 proceed into an intermediate transfer nip portion at which the photoconductor drum 56 and the intermediate transfer belt 58 make contact with each other and then are intermediately transferred in a state where they are superimposed on the intermediate transfer belt 58 while influenced by a bias from the intermediate transfer bias roller 57, thereby forming a four-color superimposed toner image with the four colors superimposed.

Along with the rotation, the surface of the photoconductor drum 56 that passed the intermediate transfer nip portion is then cleaned by a drum cleaning unit 55 to remove a transfer residual toner remaining thereon. The cleaning unit 55 is configured to remove a transfer residual toner using a cleaning roller to which a cleaning bias is applied, however, it may be the one using a cleaning brush such as a fur brush and a magnetic fur brush, or a cleaning blade.

In the surface of the photoconductor drum 56 on which the transfer residual toner has been removed, a charge is eliminated by a charge eliminating lamp 54. For the charge eliminating lamp 54, a fluorescent light, tungsten lamp, halogen lamp, mercury vapor lamp, sodium lamp, light emitting diode (LED), laser diode (LD) and electro luminescence (EL) or the like is used. For light emitted therefrom, it may be designed to use only a desired wavelength by using a filter selected from various filters such as sharp cut filters, band pass filters, near-infrared cutting filters, dichroic filters, interference filters and color temperature conversion filters.

In the meanwhile, a pair of resist rollers 61 in which a recording medium 60 sent from a paper feeding cassette is nipped between two rollers is sent toward the secondary transfer nip portion at just the time when the recording medium 60 can be superimposed on the four-color superimposed toner image. The four-color superimposed toner image on the intermediate transfer belt 58 is influenced by a secondary transfer bias from a paper transfer bias roller 63 in the secondary transfer nip portion and is then secondarily transferred onto the recording medium 60 at a time. By the secondary transfer, a full-color image can be formed on the recording medium 60.

The recording medium 60 with the full-color image formed thereon is sent to a paper conveying belt 64 by a transfer belt 62. The paper conveying belt 64 sends the recording medium 60 received from the transferring into a fixing device 65. The fixing device 65 conveys the sent recording medium 60 with nipping the recording medium 60 in between fixing nips that are formed by a contact of a heating roller with a backup roller. The full-color image on the recording medium 60 is affected by heat applied from the heating roller and an applied pressure within the fixing nips and is then fixed on the recording medium 60 (transfer sheet).

Note that a bias for adsorbing the recording medium 60 is applied to the transfer belt 62 and the paper conveying belt 64, respectively, although they are not illustrated in the figure. Further, the intermediate transferring is provided with a paper charge eliminating charger which eliminates a charge on the recording medium 60 and three belt charge eliminating chargers to eliminate charge on respective belts (an intermediate transfer belt 58, a transfer belt 62 and a conveying belt 64). Further, the intermediate transferring is equipped with a belt cleaning unit having a similar configuration to that of the drum cleaning unit 55. A transfer residual toner remaining on the intermediate transfer belt 58 is removed by the drum cleaning unit 55.

Figure 11:
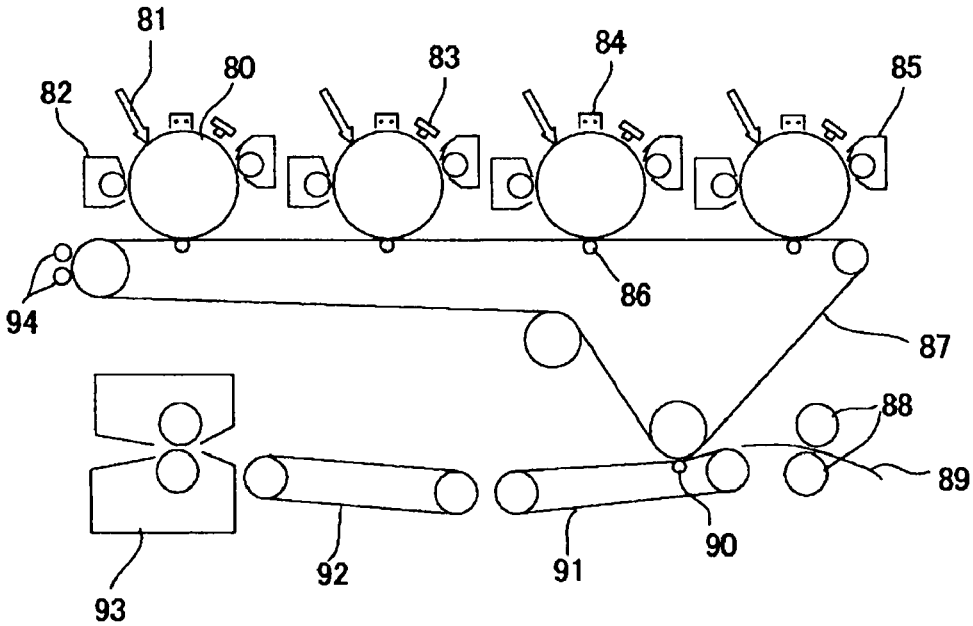
FIG. 11 is a schematic view showing one example of a tandem image forming apparatus of the present invention.

Next, FIG. 11 is a schematic view showing another example of the image forming apparatus of the present invention. The image forming apparatus is a so-called tandem type printer and is provided with photoconductor drums 80C, 80M, 80Y and 80Bk respectively used for four color toners of cyan (C), magenta (M), yellow (Y) and black (K), not sharing the photoconductor 56 with each of the four colors, as can be seen FIG. 10. The image forming apparatus is further equipped with drum cleaning units 85, charge elimination lamps 83 and charging chargers 84 respectively provided for each of four colors of cyan (C), magenta (M), yellow (Y) and black (K).

In the tandem type printer, latent electrostatic images of four colors can be formed in parallel and can be developed in parallel, and thus the tandem type printer allows for achieving a much higher image forming rate than that of the revolver type printer. Since a plurality of image forming units are provided in the small tandem type color image forming apparatus, ozone concentration is likely to increase around the charging unit, and unevenness of the ozone concentration is likely to occur around the discharge region. However, the ozone concentration and the variation thereof are maintained at the predetermined range by providing the airflow adjusting device according to the present invention and adding a compound represented by any one of General Formulas (1) and (2) to the outermost surface layer of the photoconductor. This makes it possible to prevent image deletion, image blur, and the unevenness of the halftone image density.

The image forming units in the image forming apparatus explained as above may be incorporated into a copier, a facsimile or a printer or may be incorporated in a form of a process cartridge, which will be hereinafter explained, into an image forming apparatus.

(Process Cartridge)

A process cartridge according to the present invention is provided with an electrophotographic photoconductor and at least one unit selected from a charging unit, an exposing unit, a developing unit, a transferring unit, a cleaning unit and a charge eliminating unit, and is used in the image forming apparatus of the present invention.

Figure 12:
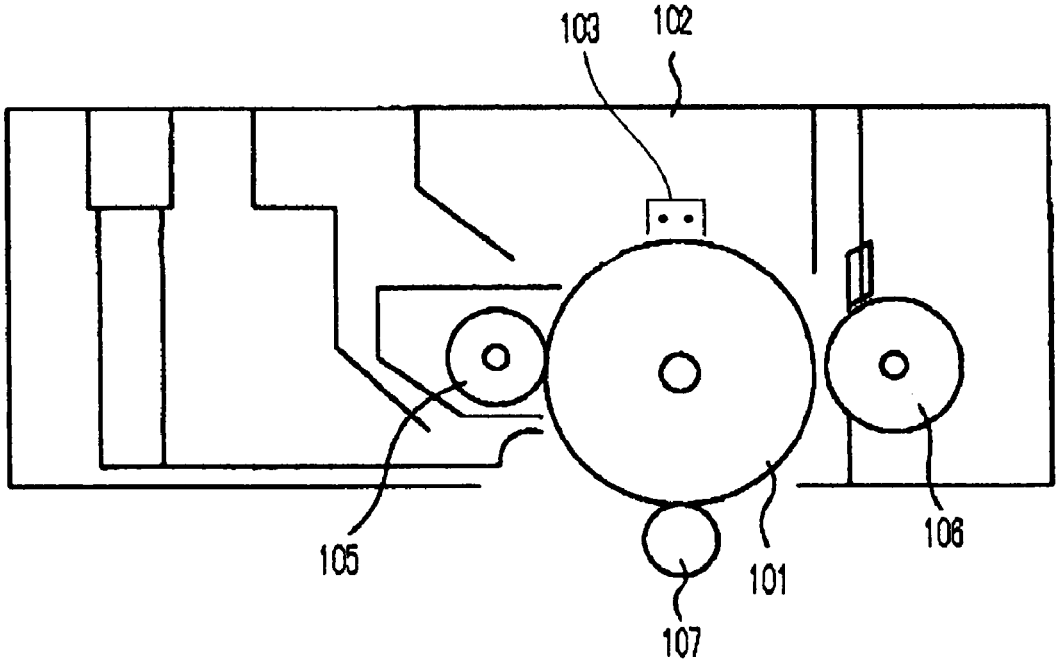
FIG. 12 is a schematic view showing one example of a process cartridge of the present invention.

FIG. 12 is a schematic view showing the configuration of an image forming apparatus equipped with the cartridge of the present invention. A photoconductor 101 has at least a photosensitive layer on a substrate, and the outermost surface layer contains a compound represented by any one of General Formulas (1) and (2) and a filler. A reference numeral 103 denotes a charging unit, a reference numeral 106 denotes a developing unit, a reference numeral 107 denotes a transferring, and a reference numeral 105 denotes a cleaning unit.

In the present invention, among the constitutional elements including the photoconductor 101, the charging unit 103, the developing unit 106 and the cleaning unit 105, at least the photoconductor 101 and the developing unit 106 are integrally combined into one unit of process cartridge, and the process cartridge can be detachably mounted to the main body of an image forming apparatus such as a copier and a printer.

EXAMPLES

Hereafter, the present invention will be further described in detail referring to specific Examples, however, the present invention is not limited to the disclosed Examples.

Production Example 1

Preparation of Electrophotographic Photoconductor 1

Over the surface of an aluminum cylinder, an undercoat layer coating solution, a charge generating layer coating solution and a charge transporting layer coating solution each having the following composition were applied in this order by immersion coating, the applied coating solutions were respectively dried to thereby form an undercoat layer having a thickness of 3.5 μm, a charge generating layer having a thickness of 0.2 μm and a charge transporting layer having a thickness of 22 μm, respectively.

<Composition of Undercoat Layer Coating Solution>

| | |
|---|---|
| Titanium dioxide powder | 400 parts by mass |
| Melamine resin | 65 parts by mass |
| Alkyd resin | 120 parts by mass |
| 2-butanone | 400 parts by mass |

<Composition of Charge Generating Layer Coating Solution>

Bisazo pigment represented by the following structural formula . . . 12 parts by mass

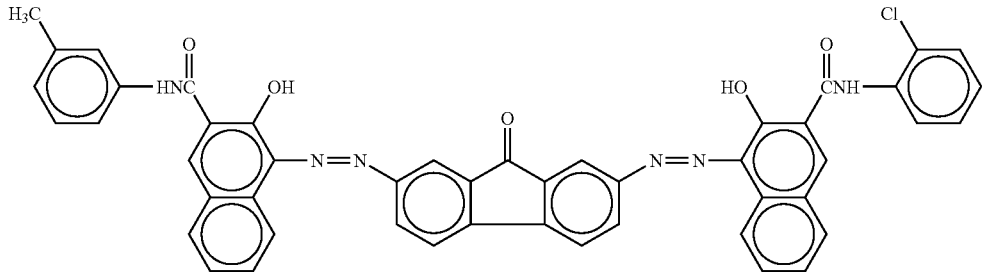

Polyvinyl butyral . . . 5 parts by mass 2-butanone . . . 200 parts by mass

Cyclohexanone . . . 400 parts by mass

<Composition of Charge Transporting Layer Coating Solution>

Polycarbonate (Z POLICA, manufactured by Teijin Chemicals, Ltd.) . . . 10 parts by mass Charge transporting material represented by the following structural formula . . . 10 parts by mass

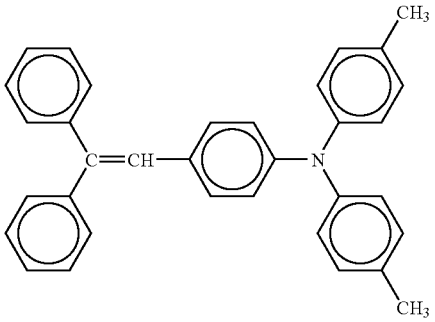

Tetrahydrofuran . . . 100 parts by mass

Next, on the charge transporting layer, a protective layer coating solution having the following composition was applied by spray coating to thereby form a protective layer having a thickness of 5.0 μm. With the treatments stated above, an electrophotographic photoconductor 1 was prepared.

<Composition of Protective Layer Coating Solution>

Alumina filler (average primary particle diameter: 0.3 μm, SUMICORANDOM AA-03, manufactured by Sumitomo Chemical Co., Ltd.) . . . 2 parts by mass Unsaturated polycarboxylic polymer solution (acidic value: 180 mgKOH/g, solid content: 50% by mass, BYK-P104 manufactured by BYK Chemie Co.) . . . 0.02 parts by mass Exemplified Compound 9 represented by the following structural formula . . . 0.6 parts by mass

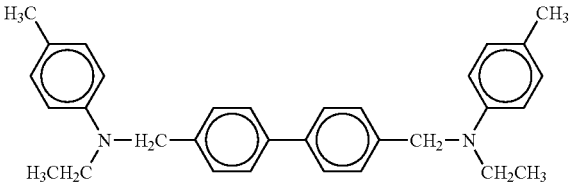

Charge transporting material represented by the following structural formula . . . 3 parts by mass

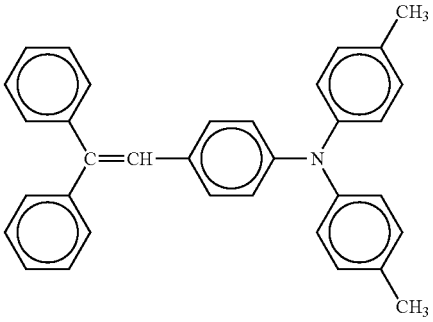

Polycarbonate (Z POLICA, manufactured by Teijin Chemicals, Ltd.) . . . 5 parts by mass Tetrahydrofuran . . . 250 parts by mass Cyclohexanone . . . 70 parts by mass Production Example 2

Preparation of Electrophotographic Photoconductor 2

An electrophotographic photoconductor 2 was prepared in the same manner as in Production Example 1 except that the protective coating solution was changed to a protective coating solution having the following composition.

<Composition of Protective Layer Coating Solution>

Alumina filler (average primary particle diameter: 0.3 μm, SUMICORANDOM AA-03, manufactured by Sumitomo Chemical Co., Ltd.) . . . 2 parts by mass Unsaturated polycarboxylic polymer solution (acidic value: 180 mgKOH/g, solid content: 50% by mass, BYK-P104 manufactured by BYK Chemie Co.) . . . 0.02 parts by mass Exemplified Compound 2 represented by the following structural formula . . . 1.8 parts by mass

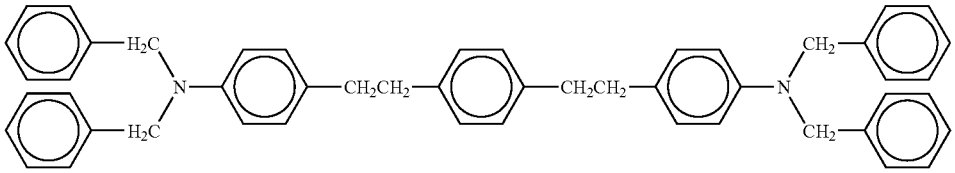

Charge transporting material represented by the following structural formula . . . 1.8 parts by mass

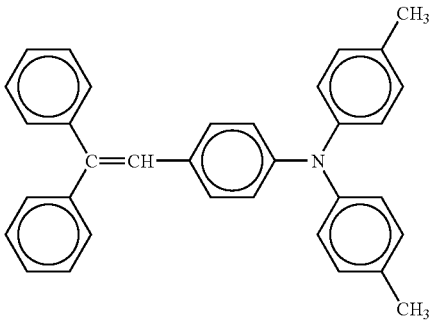

Polycarbonate (Z POLICA, manufactured by Teijin Chemicals, Ltd.) . . . 5 parts by mass Tetrahydrofuran . . . 250 parts by mass Cyclohexanone . . . 70 parts by mass Production Example 3

Preparation of Electrophotographic Photoconductor 3

An electrophotographic photoconductor 3 was prepared in the same manner as in Production Example 1 except that the protective layer coating solution was changed to a protective layer coating solution having the following composition.

<Composition of Protective Layer Coating Solution>

Alumina filler (average primary particle diameter: 0.3 μm, SUMICORANDOM AA-03, manufactured by Sumitomo Chemical Co., Ltd.) . . . 1 part by mass Unsaturated polycarboxylic polymer solution (acidic value: 180 mgKOH/g, solid content: 50% by mass, BYK-P104 manufactured by BYK Chemie Co.) . . . 0.01 parts by mass Exemplified Compound 9 represented by the following structural formula . . . 0.6 parts by mass

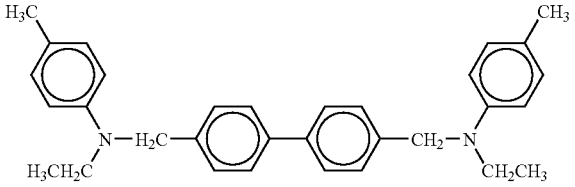

Charge generating material represented by the following structural formula . . . 3 parts by mass

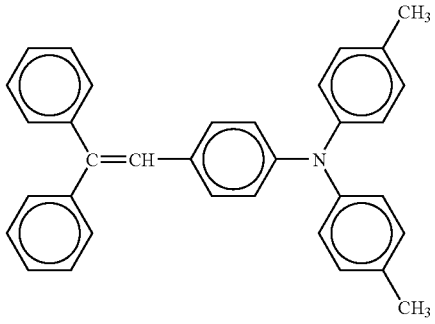

Polycarbonate (Z POLICA, manufactured by Teijin Chemicals, Ltd.) . . . 5 parts by mass Tetrahydrofuran . . . 250 parts by mass Cyclohexanone . . . 70 parts by mass Production Example 4

Preparation of Electrophotographic Photoconductor 4

An electrophotographic photoconductor 4 was prepared in the same manner as in Production Example 1 except that the protective layer coating solution was changed to a protective layer coating solution having the following composition.

<Composition of Protective Layer Coating Solution>

Alumina filler (average primary particle diameter: 0.3 μm, SUMICORANDOM AA-03, manufactured by Sumitomo Chemical Co., Ltd.) . . . 3 parts by mass Unsaturated polycarboxylic polymer solution (acidic value: 180 mgKOH/g, solid content: 50% by mass, BYK-P104 manufactured by BYK Chemie Co.) . . . 0.03 parts by mass Charge transporting material of Exemplified Compound 9 represented by the following structural formula . . . 0.9 parts by mass

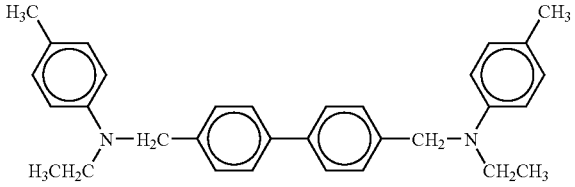

Charge transporting material represented by the following structural formula . . . 4 parts by mass

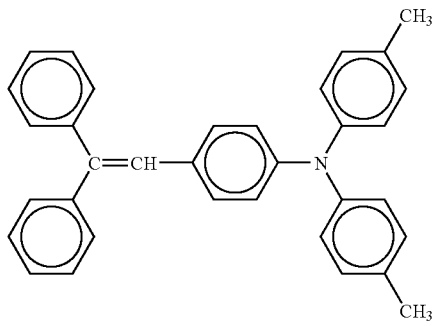

Polycarbonate (Z POLICA, manufactured by Teijin Chemicals, Ltd.) . . . 3 parts by mass Tetrahydrofuran . . . 250 parts by mass Cyclohexanone . . . 70 parts by mass Production Example 5

Preparation of Electrophotographic Photoconductor 5

An electrophotographic photoconductor 5 was prepared in the same manner as in Production Example 1 except that the protective layer coating solution was changed to a protective layer coating solution having the following composition.

<Composition of Protective Layer Coating Solution>

Alumina filler (average primary particle diameter: 0.5 μm, SUMICORANDOM AA-05, manufactured by Sumitomo Chemical Co., Ltd.) . . . 3 parts by mass Unsaturated polycarboxylic polymer solution (acidic value: 180 mgKOH/g, solid content: 50% by mass, BYK-P104 manufactured by BYK Chemie Co.) . . . 0.02 parts by mass Charge transporting material of Exemplified Compound 9 represented by the following structural formula . . . 0.9 parts by mass

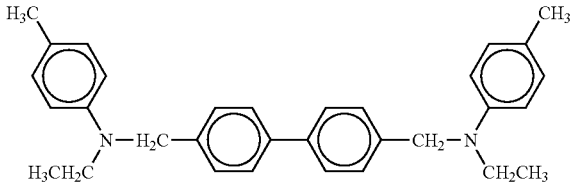

Charge transporting material represented by the following structural formula . . . 4 parts by mass

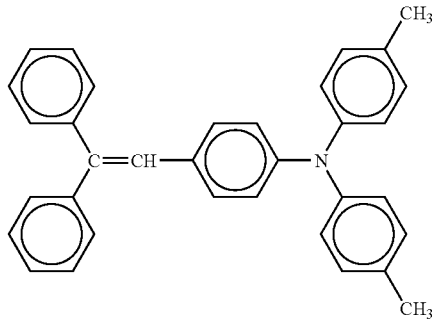

Polycarbonate (Z POLICA, manufactured by Teijin Chemicals, Ltd.) . . . 3 parts by mass Tetrahydrofuran . . . 250 parts by mass Cyclohexanone . . . 70 parts by mass Production Example 6

Preparation of Electrophotographic Photoconductor 6

An electrophotographic photoconductor 6 was prepared in the same manner as in Production Example 1 except that the protective layer coating solution was changed to a protective layer coating solution having the following composition.

<Composition of Protective Layer Coating Solution>

Alumina filler (average primary particle diameter: 0.3 μm, SUMICORANDOM AA-03, manufactured by Sumitomo Chemical Co., Ltd.) . . . 2 parts by mass Unsaturated polycarboxylic polymer solution (acidic value: 180 mgKOH/g, solid content: 50% by mass, BYK-P104 manufactured by BYK Chemie Co.) . . . 0.02 parts by mass Charge transporting material represented by the following structural formula . . . 4 parts by mass

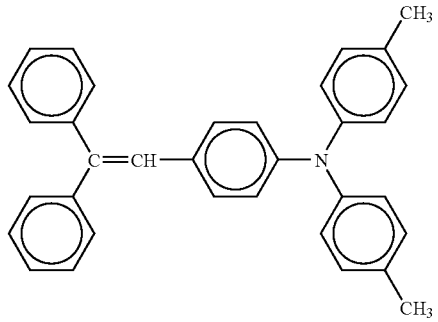

Polycarbonate (Z POLICA, manufactured by Teijin Chemicals, Ltd.) . . . 6 parts by mass Tetrahydrofuran . . . 220 parts by mass Cyclohexanone . . . 80 parts by mass Image forming apparatuses 1 to 6 with airflow adjusting devices in the vicinity of charging units were prepared. Specifically, an image forming apparatus, imagio NeoC600 (manufactured by Ricoh Company Ltd), was prepared. A charging unit was replaced with a corona discharge type charger (scorotron charger), and the apparatus provided with an airflow adjusting unit in the vicinity of the scorotoron charger was used. Note that the wire current of the scorotoron charger was set to 1.2 mA.

(An Airflow Adjusting Unit of an Image Forming Apparatus 1)

Air was taken from the outside of the image forming apparatus by using a fan. The air was carried to in order of a first duct, the back of a charging unit, the inside of the charging unit and the electrophotographic photoconductor placed to face the charging unit. The air was exhausted to the outside of the image forming apparatus from a gap between the charging unit and the electrophotographic photoconductor through a second duct by using a fan.

(An Airflow Adjusting Unit of an Image Forming Apparatus 2)

Air was taken from the outside of an image forming apparatus 2 by using a fan. The air was carried to in order of a first duct, a gap between the charging unit and the electrophotographic photoconductor, which were placed to face each other, the inside of the charging unit and the back of the charging unit. The air was exhausted to the outside of the image forming apparatus from the back of the charging unit through a second duct.

(An Airflow Adjusting Unit of an Image Forming Apparatus 3)

An image forming apparatus image 3 was prepared. The image forming apparatus 3 was configured in the same manner as the image forming apparatus 1, except that the rotation rate of the fan was reduced by ⅔.

(An Airflow Adjusting Unit of an Image Forming Apparatus 4)

An image forming apparatus image 4 was prepared. The image forming apparatus 4 was configured in the same manner as the image forming apparatus 2, except that the rotation rate of the fan was reduced by ⅔.

(An Airflow Adjusting Unit of an Image Forming Apparatus 5)

Air was taken from the outside of the image forming apparatus by using two fans. The air was carried to in order of two ducts, the back of the charging unit, the inside of the charging unit and the electrophotographic photoconductor placed to face the charging unit. The air was exhausted to the outside of the image forming apparatus from a gap between the charging unit and the electrophotographic photoconductor through two other ducts. Note that the fans used in the image forming apparatus 5 were configured in the same manner as the fans used in the image forming apparatuses 1 to 4. The rotation rate of the fans was reduced by ⅔ as in the image forming apparatuses 3 and 4.

(An Airflow Adjusting Unit of an Image Forming Apparatus 6)

An image forming apparatus 6 was prepared. The image forming apparatus 6 was configured in the same manner as the image forming apparatus 1, except that the rotation rate of the fan was reduced by ⅔.

As for the image forming apparatuses 1 to 6, the ozone concentration and the variation thereof were evaluated.

<Measurement of the Ozone Concentration>

A hole with a diameter of 6 mm was made on a photoconductor drum jig in an image forming region of the charging unit. Teflon (registered trademark) tube was fitted to the hole and fixed with an adhesive. The opening of the other end of the tube was connected to an ozone concentration meter. The photoconductor drum jig was mounted on an image forming apparatus so that the opening of the Teflon (registered trademark) on the drum was set right under the center portion of a scorotron charger. Without rotating the drum jig, the charging unit and the fan were operated in the same manner as in normal image formation. After two minutes, the ozone concentration was measured at different spots, and the unevenness of the ozone concentration was calculated. The ozone concentration was measured at seven spots interposed with an interval of 50 mm in the image forming region.

Table 1 shows the ozone concentration at the surface of the electrophotographic photoconductor in the discharge region (in the image forming region) of the scorotron charger (the charging unit) in the image forming apparatuses 1 to 6.

TABLE 1

| | Ozone Concentration (ppm) | | | |
|---|---|---|---|---|
| | Average | Maximum | Minimum | Unevenness |
| Image Forming Apparatus 1 | 16.6 | 20.6 | 8.1 | 12.5 |
| Image Forming Apparatus 2 | 11.9 | 14.8 | 5.1 | 9.7 |
| Image Forming Apparatus 3 | 29.5 | 31.6 | 16.8 | 14.8 |
| Image Forming Apparatus 4 | 20.3 | 24.6 | 11.2 | 13.4 |
| Image Forming Apparatus 5 | 10.3 | 12.5 | 5.7 | 6.8 |
| Image Forming Apparatus 6 | 35.2 | 41.5 | 22.3 | 19.2 |

Examples 1 to 11 and Comparative Examples 1 to 11

Image Formation

The image forming apparatuses 1 to 6 were used. The electrophotographic photoconductor previously prepared were used in combination with the image forming apparatuses as shown in Table 2 below. Dark space potential was set to 800 (−V), a total of 100,000 sheets with A4 size lateral were printed out thereafter. Potential at a bright area, abrasion loss of the photoconductor and image quality (image blur and unevenness of halftone density) of the printed sheets were evaluated as described below at the initial stage of the printing and after 100,000 sheets were printed out.

Next, 10,000 sheets were similarly printed out after printing out 100,000 sheets under the condition of a temperature of 27° C. and a relative humidity of 80%. The image quality (image blur and unevenness of halftone density) of the printed sheets was evaluated.

(Image Quality Evaluation, Potential at a Bright Area and Abrasion Loss of the Photoconductor)

An image print output in the initial stage of the printing and an image print output after the repetitive output test of 50,000 sheets were visually observed to evaluate the image quality (image blur and halftone density). A potential at a bright area in the initial stage of the printing and a potential at the bright area after the repetitive output test were measured. The results are shown in Table 2 below.

(Evaluation of Image Blur)

Image blur was evaluated with visual observation based on the following criteria:

A: Image blur was not confirmed;

B: Image blur was slightly confirmed, but it was acceptable upon use; and

C: Image blur was significant.

(Evaluation of Unevenness of Halftone Density)

Image Blur was evaluated with visual observation based on the following criteria:

A: Unevenness of the density was not confirmed;

B: Unevenness of the density was slightly confirmed, but it was acceptable upon use; and C: Unevenness of the density was significant.

(Abrasion Loss of Photoconductor)

An abrasion loss of the photoconductor was determined by subtracting the thickness of the photoconductor after a repetitive output test of 100,000 sheets from the thickness of the photoconductor in the initial stage of the printing. The thickness of the photoconductor was measured using an eddy-current film thickness meter the surface of the electrophotographic photoconductor in the discharge region of the charging unit, the image forming region of the charging unit. On the other hand, satisfactory images could not be obtained in the image forming apparatuses in the comparative examples 1 to 6 in which the outermost surface layer of the photoconductor did not contain a compound represented by any one of General Formulas (1) and (2), and in the comparative examples 7 to 11 in which the ozone concentration and the unevenness thereof were high.

What is claimed is:

1. An image forming apparatus, comprising:

a corona discharge type charging unit which discharges in a non-contact manner;

TABLE 2

| | | | Potential at Bright Area (−V) | | Abrasion | Image Quality UP TO 100,000 SHEETS | | Image Quality (27° C., 80% RH) | |
|---|---|---|---|---|---|---|---|---|---|
| Example | Photoconductor | Image Forming Apparatus | Initial Stage | After printing 100,000 sheets | Loss (μm) | Image Blur | Unevenness of Halftone Density | Image Blur | Unevenness of Halftone Density |
| Example 1 | 1 | 1 | 63 | 142 | 0.18 | A | A | A | A |
| Example 2 | 1 | 2 | 59 | 126 | 0.00 | A | A | A | A |
| Example 3 | 1 | 3 | 60 | 141 | 0.01 | A | A | A | A |
| Example 4 | 1 | 4 | 63 | 129 | 0.31 | A | A | A | A |
| Example 5 | 1 | 5 | 59 | 138 | 0.07 | A | A | A | A |
| Example 6 | 2 | 1 | 60 | 140 | 0.07 | A | A | A | A |
| Example 7 | 2 | 3 | 61 | 130 | 0.09 | A | A | A | A |
| Example 8 | 2 | 4 | 64 | 132 | 0.27 | A | A | A | A |
| Example 9 | 3 | 3 | 51 | 119 | 0.15 | A | A | A | A |
| Example 10 | 4 | 3 | 60 | 136 | 0.11 | A | A | B | B |
| Example 11 | 5 | 3 | 64 | 129 | 0.03 | A | A | B | B |
| Comparative Example 1 | 6 | 1 | 58 | 138 | 0.10 | B (after printing 80,000 sheets) | B (after printing 60,000 sheets) | C | C |
| Comparative Example 2 | 6 | 2 | 60 | 141 | 0.10 | A | B (after printing 80,000 sheets) | C | C |
| Comparative Example 3 | 6 | 3 | 55 | 143 | 0.08 | B (after printing 60,000 sheets) | C (after printing 50,000 sheets) | C | C |
| Comparative Example 4 | 6 | 4 | 54 | 130 | 0.39 | A | B (after printing 60,000 sheets) | C | C |
| Comparative Example 5 | 6 | 5 | 62 | 139 | 0.39 | A | B (after printing 80,000 sheets) | C | C |

| | | | Potential at Bright Area (−V) | | Abrasion | Image Quality | | Image Quality (27° C., 80% RH) | |
|---|---|---|---|---|---|---|---|---|---|
| Example | Photoconductor | Image Forming Apparatus | Initial Stage | After printing 50,000 sheets | Loss (μm) | Image Blur | Unevenness of Halftone Density | Image Blur | Unevenness of Halftone Density |
| Comparative Example 6 | 6 | 6 | 62 | 135 | 0.17 | B (after printing 50,000 sheets) | C (after printing 40,000 sheets) | C | C |
| Comparative Example 7 | 1 | 6 | 57 | 132 | 0.08 | A | B (after printing 100,000 sheets) | B | C |
| Comparative Example 8 | 2 | 6 | 63 | 130 | 0.40 | A | B (after printing 100,000 sheets) | B | C |
| Comparative Example 9 | 3 | 6 | 47 | 124 | 0.32 | A | A | B | C |
| Comparative Example 10 | 4 | 6 | 60 | 138 | 0.31 | A | B (after printing 80,000 sheets) | B | C |
| Comparative Example 11 | 5 | 6 | 63 | 144 | 0.37 | A | B (after printing 80,000 sheets) | B | C |

From the results shown in Tables 1 and 2, it is clear that abnormal images with image blur and unevenness of halftone density were suppressed and high quality images can be stably obtained in the image forming apparatuses in the examples 1 to 11, in which the corona discharge type charging unit was provided, the outermost surface layer of the photoconductor contained a filler and a compound represented by any one of General Formulas (1) and (2), the ozone concentration and the unevenness thereof were maintained at an average of 30 ppm or less and 15 ppm or less respectively at an electrophotographic photoconductor which has an outermost surface layer containing a filler; and an airflow adjusting device which takes air from an outside of the image forming apparatus, carries the air to a vicinity of any one of the charging unit and the electrophotographic photoconductor and exhausts the air to the outside of the image forming apparatus, wherein the charging unit and the electrophotographic photoconductor are placed to face each other, the airflow adjusting device maintains ozone concentration at an average of 30 ppm or less and unevenness of the ozone concentration at 15 ppm or less at a surface of the electrophotographic photoconductor in a discharge region in an image forming area of the charging unit, and the outermost surface layer of the electrophotographic photoconductor contains a compound represented by any one of the following General Formulas (1) and (2), General Formula (1)

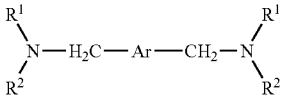

where $R^1$ and $R^2$ may be identical to each other or different from each other, represent any one of an alkyl group that may have a substituent group and an aryl group that may have a substituent group, at least one of the $R^1$ and $R^2$ is the aryl group that may have the substituent group, the $R^1$ and $R^2$ may be combined to each other to form a heterocyclic ring containing a nitrogen atom, and the heterocyclic ring may be further substituted by a substituent group; and Ar represents an aryl group that may have a substituent group, General Formula (2)

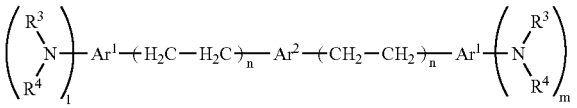

where $R^3$ and $R^4$ may be identical to each other or different from each other, represent an unsubstituted alkyl group or an alkyl group substituted by an aromatic hydrocarbon group, the $R^3$ and $R^4$ may be combined to each other to form a heterocyclic ring containing a nitrogen atom, and the heterocyclic ring may be further substituted by a substituent group; $Ar^1$ and $Ar^2$ represent an aryl group that may have a substituent group; "l" and "m" represent an integer of 0 to 3, and both of the "l" and "m" cannot be an integer of 0 (zero) at the same time; and "n" is an integer of 1 or 2.

2. The image forming apparatus according to claim 1, wherein the airflow adjusting device includes a unit which takes the air from the outside of the image forming apparatus, carries the air to the electrophotographic photoconductor from a back of the charging unit through an inside of the charging unit, exhausts the air to the outside of the image forming apparatus from a gap between the charging unit and the electrophotographic photoconductor and maintains the ozone concentration at the average of 30 ppm or less and the unevenness of the ozone concentration at 15 ppm or less at the surface of the image forming apparatus in the discharge region of the image forming area of the charging unit.

3. The image forming apparatus according to claim 2, wherein the airflow adjusting device includes a unit which takes the air from the outside of the image forming apparatus by using at least one fan, carries the air to the inside of the charging unit from any one of the back of the charging unit and the gap between the charging unit and the electrophotographic photoconductor through a first duct, exhausts the air to the outside of the image forming apparatus through a second duct by using at least one fan and maintains the ozone concentration at the average of 30 ppm or less and the unevenness of the ozone concentration at 15 ppm or less at the surface of the image forming apparatus in the discharge region of the image forming area of the charging unit.

4. The image forming apparatus according to claim 1, wherein the airflow adjusting unit includes a unit which takes air from the outside of the image forming apparatus, carries the air to a back of the charging unit from a gap between the charging unit and the electrophotographic photoconductor through an inside of the charging unit, exhausts the air to the outside of the image forming apparatus from the back of the charging unit and maintains the ozone concentration at the average of 30 ppm or less and the unevenness of the ozone concentration at 15 ppm or less at the surface of the image forming apparatus in the discharge region of the image forming area of the charging unit.

5. The image forming apparatus according to claim 1, wherein the filler contains at least one selected from metal oxides.

6. The image forming apparatus according to claim 1, wherein the filler has an average primary particle diameter of 0.01 μm to 1.0 μm.

7. The image forming apparatus according to claim 1, wherein the filler content of the outermost surface layer is 5% by mass to 50% by mass.

8. The image forming apparatus according to claim 1, the outermost surface layer of the electrophotographic photoconductor contains an organic compound having an acidic value of 10 mgKOH/g to 700 mgKOH/g.

9. The image forming apparatus according to claim 1, wherein the electrophotographic photoconductor has a substrate, a photosensitive layer and a protective layer formed in this order on the substrate, and the protective layer is the outermost surface layer.

10. The image forming apparatus according to claim 1, further comprising an exposing unit which digitally writes a latent electrostatic image on the electrophotographic photoconductor, wherein the exposing unit is any one of a laser diode (LD) and a light-emitting diode (LED).

11. The image forming apparatus according to claim 1, wherein visual images with a plurality of colors are sequentially superimposed on the electrophotographic photoconductor to form a color image.

12. The image forming apparatus according to claim 1, further comprising a plurality of electrophotographic photoconductors, wherein monochrome visual images with a plurality of colors are sequentially superimposed on the respective electrophotographic photoconductor to form a color image.

13. The image forming apparatus according to claim 1, further comprising an intermediate transferring unit configured to primarily transfer a visual image developed on the electrophotographic photoconductor to an intermediate transfer member and then secondarily transfer the visual image on the intermediate transfer member onto a recording medium, wherein visual images with a plurality of colors are sequentially superimposed on the intermediate transfer member to form a color image, and the color image is secondarily transferred onto the recording medium at a time.

14. An image forming method, comprising repetitive steps of charging, exposing, developing, and transferring by using an image forming apparatus, wherein the image forming apparatus comprises:

a corona discharge type charging unit which discharges in a non-contact manner;

an electrophotographic photoconductor which has an outermost surface layer containing a filler; and an airflow adjusting device which takes air from an outside of the image forming apparatus, carries the air to a vicinity of any one of the charging unit and the electrophotographic photoconductor and exhausts the air to the outside of the image forming apparatus, and wherein the charging unit and the electrophotographic photoconductor are placed to face each other, the airflow adjusting device maintains ozone concentration at an average of 30 ppm or less and unevenness of the ozone concentration at 15 ppm or less at a surface of the electrophotographic photoconductor in a discharge region in an image forming area of the charging unit, and the outermost surface layer of the electrophotographic photoconductor contains a compound represented by any one of the following General Formulas (1) and (2), General Formula (1)

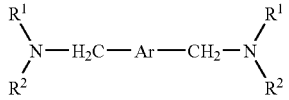

where $R^1$ and $R^2$ may be identical to each other or different from each other, represent any one of an alkyl group that may have a substituent group and an aryl group that may have a substituent group, at least one of the $R^1$ and $R^2$ is the aryl group that may have the substituent group, the $R^1$ and $R^2$ may be combined to each other to form a heterocyclic ring containing a nitrogen atom, and the heterocyclic ring may be further substituted by a substituent group; and Ar represents an aryl group that may have a substituent group, General Formula (2)

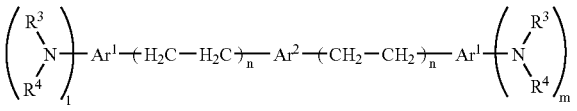

where $R^3$ and $R^4$ may be the same to each other or different from each other, represent an unsubstituted alkyl group or an alkyl group substituted by an aromatic hydrocarbon group, the $R^3$ and $R^4$ may be combined to each other to form a heterocyclic ring containing a nitrogen atom, and the heterocyclic ring may be further substituted by a substituent group; $Ar^1$ and $Ar^2$ represent an aryl group that may have a substituent group; "l" and "m" represent an integer of 0 to 3, and both of the "l" and "m" cannot be an integer of 0 (zero) at the same time; and "n" is an integer of 1 or 2.

15. A process cartridge, comprising:

an electrophotographic photoconductor, and at least one selected from a charging unit, an exposing unit, a developing unit, a transferring unit, a cleaning unit and a charge eliminating unit, wherein the process cartridge is used for an image forming apparatus, wherein the image forming apparatus comprises:

a corona discharge type charging unit which discharges in a non-contact manner;

an electrophotographic photoconductor which has an outermost surface layer containing a filler; and an airflow adjusting device which takes air from an outside of the image forming apparatus, carries the air to a vicinity of any one of the charging unit and the electrophotographic photoconductor and exhausts the air to the outside of the image forming apparatus, and wherein the charging unit and the electrophotographic photoconductor are placed to face each other, the airflow adjusting device maintains ozone concentration at an average of 30 ppm or less and unevenness of the ozone concentration at 15 ppm or less at a surface of the electrophotographic photoconductor in a discharge region in an image forming area of the charging unit, and the outermost surface layer of the electrophotographic photoconductor contains a compound represented by any one of the following General Formulas (1) and (2), General Formula (1)

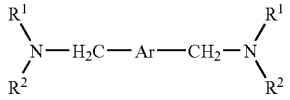

where $R^1$ and $R^2$ may be identical to each other or different from each other, represent any one of an alkyl group that may have a substituent group and an aryl group that may have a substituent group, at least one of the $R^1$ and $R^2$ is the aryl group that may have the substituent group, the $R^1$ and $R^2$ may be combined to each other to form a heterocyclic ring containing a nitrogen atom, and the heterocyclic ring may be further substituted by a substituent group; and Ar represents an aryl group that may have a substituent group, General Formula (2)

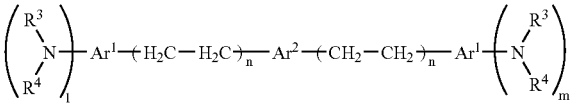

where $R^3$ and $R^4$ may be identical to each other or different from each other, represent an unsubstituted alkyl group or an alkyl group substituted by an aromatic hydrocarbon group, the $R^3$ and $R^4$ may be combined to each other to form a heterocyclic ring containing a nitrogen atom, and the heterocyclic ring may be further substituted by a substituent group; $Ar^1$ and $Ar^2$ represent an aryl group that may have a substituent group; "l" and "m" represent an integer of 0 to 3, and both of the "l" and "m" cannot be an integer of 0 (zero) at the same time; and "n" is an integer of 1 or 2.

* * * * *